US011829092B2

(12) United States Patent
Hamasaki

(10) Patent No.: US 11,829,092 B2
(45) Date of Patent: Nov. 28, 2023

(54) IMAGE FORMING APPARATUS

(71) Applicant: CANON KABUSHIKI KAISHA, Tokyo (JP)

(72) Inventor: Ryuji Hamasaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/862,548

(22) Filed: Jul. 12, 2022

(65) Prior Publication Data

US 2023/0026048 A1 Jan. 26, 2023

(30) Foreign Application Priority Data

Jul. 14, 2021 (JP) ..... 2021-116141
Dec. 20, 2021 (JP) ..... 2021-205753

(51) Int. Cl.
*G03G 15/00* (2006.01)

(52) U.S. Cl.
CPC ..... *G03G 15/5075* (2013.01)

(58) Field of Classification Search
CPC ..... G03G 21/1619; G03G 15/80; B41J 29/02; H04N 1/00559
See application file for complete search history.

(56) References Cited

U.S. PATENT DOCUMENTS 8,886,082 B2 * 11/2014 Inoue ..... G03G 21/1619 399/119
9,131,086 B2 * 9/2015 Yuzawa ..... G03G 15/5087
2020/0110354 A1 4/2020 Yuzawa
2020/0310329 A1 10/2020 Shuhama et al.
2021/0136243 A1 5/2021 Wada
2021/0232077 A1 7/2021 Shuhama et al.

FOREIGN PATENT DOCUMENTS

CN 212322059 U 1/2021
JP 2006056017 A 3/2006
JP 2013230567 A 11/2013
JP 2017161949 A 9/2017
JP 2020167312 A 10/2020
JP 2021053811 A 4/2021

OTHER PUBLICATIONS

Extended European Search Report issued in European Appln. No. 22183500.2 dated Dec. 13, 2022.

* cited by examiner

*Primary Examiner* — Leon W Rhodes, Jr.
(74) *Attorney, Agent, or Firm* — ROSSI, KIMMS & McDOWELL LLP

(57) ABSTRACT

An image forming apparatus includes: an image forming portion; a first metal side plate and a second metal side plate; an antenna; and a housing on which a discharging port is disposed, wherein the housing includes a top cover that is disposed at a position vertically higher than the first metal side plate, wherein in a region on a downstream side with respect to the antenna in a discharging direction where a recording material is discharged from the discharging port, an upper end of the first metal side plate is located at a position vertically lower than the antenna, and a resin support portion connected to the first metal side plate is disposed in the region such that the resin support portion supports the top cover, wherein the antenna and the resin support portion are disposed along the upper end of the first metal side plate.

27 Claims, 26 Drawing Sheets

IMAGE FORMING APPARATUS

BACKGROUND OF THE INVENTION

Field of the Invention

The present invention relates to an image forming apparatus that forms an image on a recording medium.

Description of the Related Art

In recent years it is common for such an image forming apparatus as a laser printer to include a wireless communication portion, so that the user can instruct various operations, such as printing and settings, to the image forming apparatus using an external device via wireless communication, in order to improve user friendliness. In the wireless communication portion, a wireless communication board (wireless module) that includes an antenna is disposed independently from a control board. The control board and the wireless communication board are connected, and an instruction from an external device is transferred from the wireless communication board to the control board. In this transfer, the communication performance of the wireless communication is influenced by the position of the wireless communication board inside the image forming apparatus and the presence of peripheral members of the wireless communication board.

As a configuration to ensure good wireless communication performance, Japanese Patent Application Publication No. 2013-230567 discloses an apparatus in which the control board and the wireless communication board are directly connected and a recessed portion is formed on a side plate, so that the antenna does not overlap with the surface of the side plate of the frame.

SUMMARY OF THE INVENTION

However, in the case of the apparatus disclosed in Japanese Patent Application Publication No. 2013-230567, the metal frame is located on the apparatus front side with respect to the wireless communication board, hence the wireless communication performance in the apparatus front direction may drop. If the operation portion and the discharged paper stacking portion are disposed on the apparatus front side and the user uses the apparatus from the apparatus front side, wireless communication using an external device is often performed from the front side of the apparatus, and in this case, a drop in wireless communication performance on the apparatus front side is particularly undesirable. On the other hand, if the wireless communication board is disposed on the apparatus front side in order to improve the wireless communication performance on the apparatus front side, then the distance between the control board, which is disposed on the apparatus rear side, and the wireless communication board increases. Therefore the cable communication portion increases and the apparatus becomes vulnerable to noise, which in some cases deteriorates wireless communication performance. Further, forming a notch, such as a recessed portion, on the frame leads to a decrease in rigidity of the apparatus.

With the foregoing in view, it is an object of the present invention to provide an image forming apparatus configured to perform wireless communication that can ensure rigidity of the apparatus and also ensure good communication performance.

To achieve the above object, an image forming apparatus of the present invention includes:

an image forming portion configured to form an image on a recording material;

a first metal side plate and a second metal side plate disposed to sandwich the image forming portion;

an antenna configured to communicate with an external device; and a housing on which a discharging port to discharge a recording material, on which an image is formed by the image forming portion, is disposed, wherein the housing includes a top cover that is disposed at a position vertically higher than the first metal side plate, wherein in a region on a downstream side with respect to the antenna in a discharging direction where a recording material is discharged from the discharging port, an upper end of the first metal side plate is located at a position vertically lower than the antenna, and a resin support portion connected to the first metal side plate is disposed in the region such that the resin support portion supports top cover, wherein the antenna and the resin support portion are disposed along the upper end of the first metal side plate.

Further, to achieve the above object, an image forming apparatus of the present invention includes:

An image forming apparatus comprising:

an image forming portion configured to form an image on a recording material;

a first metal side plate and a second metal side plate disposed to sandwich the image forming portion;

an antenna configured to communicate with an external device;

a housing in which the image forming portion is disposed; and a feeding cassette configured to store a recording material, and to be insertable to or withdrawable from the housing, wherein the housing includes a top cover that is disposed at a position vertically higher than the first metal side plate, wherein in a region on a downstream side with respect to the antenna in the withdrawing direction of the feeding cassette, an upper end of the first side plate is located at a position vertically lower than the antenna, and a resin support portion connected to the first metal side plate is disposed in the region such that the resin support portion supports the top cover, wherein the antenna and the resin support portion are disposed along the upper end of the first metal side plate.

Further, to achieve the above object, an image forming apparatus of the present invention includes:

an image forming portion configured to form an image on a recording material;

a first metal side plate and a second metal side plate disposed to sandwich the image forming portion;

an antenna configured to communicate with an external device;

an operation portion configured to be operated by the user; and a housing in which the image forming portion is disposed, wherein the housing includes a top cover that is disposed at a position vertically higher than the first metal side plate, wherein when viewed in a direction vertical to the surface of the first metal side plate, the antenna and the operation portion are disposed in a horizontal direction, and in a region on a side where the operation portion is disposed, with respect to the antenna in the horizontal direction, an upper end of the first metal side plate is located at a position vertically lower than the antenna, and a resin support portion connected to the first metal side plate is disposed in the region such that the resin support portion supports the top cover, wherein the antenna and the resin support portion are disposed along the upper end of the first metal side plate.

According to the present invention, an image forming apparatus configured to perform wireless communication that can ensure rigidity of the apparatus and also ensure good communication performance can be provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

In Embodiment 1, a case where the present invention is applied to a tandem (four-drum type) color laser beam printer, which can form full color images using an electrophotographic system, will be described. Application of the present invention is not limited to this, and the present invention is also applicable to copiers, printers and the like using an electrostatic recording system or an inkjet recording system.

In the following description, directions are defined with respect to the user who is using the image forming apparatus 100. In other words, in a state of using the image forming apparatus 100, front side (front face side) of the image forming apparatus 100 that the user is facing is "front", rear face side (back side) is "rear"; upper face side (top face side) is "up", and lower face side (bottom face side) is "down". The left side face side of the image forming apparatus 100, when the image forming apparatus 100 is viewed from the front face side, is "left", and the right side face side thereof is "right".

(1) General Configuration of Image Forming Apparatus 100

Figure 1:
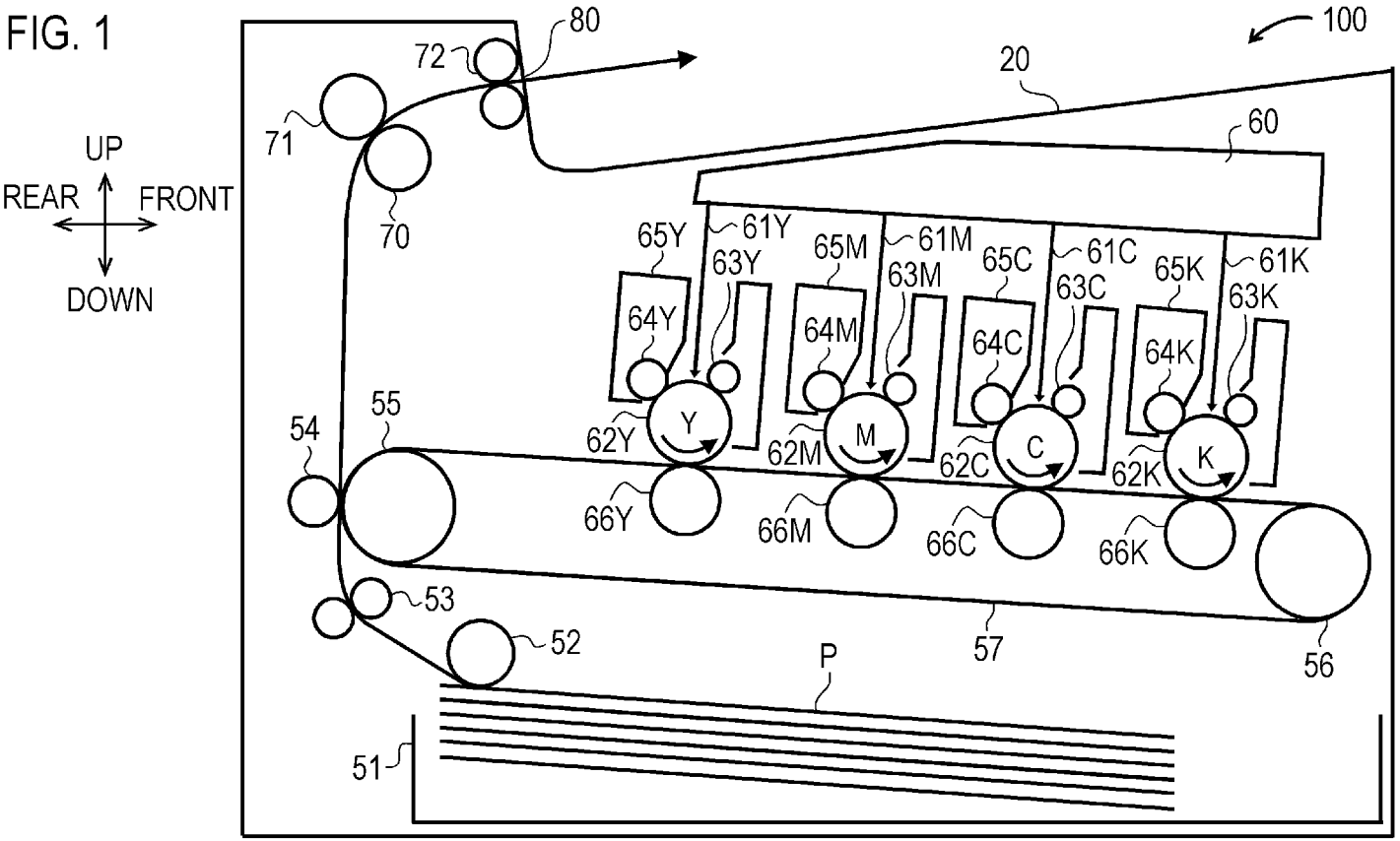
FIG. 1 is a schematic cross-sectional view of an image forming apparatus according to Embodiment 1.

FIG. 1 is a schematic cross-sectional view from the left side face side depicting a general configuration of the image forming apparatus 100 using an electrophotographic recording technique according to Embodiment 1 of the present invention. The image forming apparatus 100 includes an image forming portion and a fixing portion supported by a metal frame 20. The image forming apparatus 100 includes four image forming portions which are disposed approximately on a line, and each of the image forming portions forms an image of a color respectively: yellow (hereafter Y), magenta (hereafter M), cyan (hereafter C) or black (hereafter K). In the present embodiment, the configuration and operation of each image forming portion are substantially the same, except that a color of an image to be formed is different. Hence unless special differentiation is required, the suffix Y, M, C or K, which is attached to a reference sign to indicate the color handled by the composing element, is omitted in the following description.

Each image forming portion includes a photosensitive drum 62 (image bearing member), a charging roller 63, a developing roller 64, and a toner container 65. The image forming portion may have a configuration of a process cartridge, which is integrally detachable from the apparatus.

When image information is received and the image forming operation is started, the photosensitive drum 62 is rotated in the arrow direction indicated in FIG. 1. First the outer peripheral surface of the photosensitive drum 62 is uniformly charged by the charging roller 63, and the charged surface is irradiated with a laser beam 61 from a scanner unit 60 in accordance with the image information, so as to form an electrostatic latent image. The latent image becomes visible by the developing roller 64, whereby a toner image is formed on the surface of the photosensitive drum. The toner image formed by each image forming portion is transferred to an intermediate transfer belt 57 (intermediate transfer member).

The intermediate transfer belt 57, which is an endless belt member, is stretched by a driver roller 55 and a driven roller 56, along the direction where the image forming portions are disposed. The intermediate transfer belt 57 rotates along each image forming portion by the driver roller 55 rotating in accordance with a print instruction. On an inner peripheral surface side of the intermediate transfer belt 57, a primary roller 66 is disposed so as to face the photosensitive drum 62, and a toner image formed by each image forming portion is sequentially transferred to the intermediate transfer belt 57 by the primary roller 66 pressing the intermediate transfer belt 57 toward the photosensitive drum 62. The toner image transferred to the intermediate transfer belt 57 is conveyed to a transfer nip portion (contact portion with a secondary transfer roller 54) by the intermediate transfer belt 57 further rotating.

A sheet type recording material P, which is stored in a feeding cassette 51 disposed in a lower portion of the image forming apparatus 100 before forming an image, is separated and fed one-by-one from the feeding cassette 51 to a resist roller pair 53 by a feeding roller 52. The resist roller pair 53 conveys the recording material P which was fed into a transfer nip portion between the intermediate transfer belt 57 and a secondary transfer roller 54. The secondary transfer roller 54 is disposed to face the driver roller 55 with the intermediate transfer belt 57 therebetween. Then when the recording material P passes the transfer nip portion, bias is applied to the secondary transfer roller 54 from a high voltage power supply (not illustrated). Thereby a full color toner image is secondarily transferred from the surface of the intermediate transfer belt 57 to the recording material P which is passing through the transfer nip portion.

The recording material P bearing the toner is conveyed to a fixing portion (image heating portion). The fixing portion includes a heating unit 70 where a heater is disposed on the inner side of a flexible tubular film, and a pressure roller 71 which is disposed to face the heating unit 70. The carried toner image is fixed to the recording material P by pressing the conveyed recording material P with heat in the fixing nip portion, which is constituted of the heating unit 70 and the pressure roller 71. Then the recording material P is discharged out of the image forming apparatus 100 (arrow direction indicated in FIG. 1) by a discharging roller 72. In the present embodiment, the user operates the apparatus from the front side of the apparatus, hence the recording material P is discharged to a discharged paper stacking portion 11*e*, which is disposed on the front side of the apparatus, through a discharging port 80, which is disposed on the rear side of the apparatus. In other words, the discharging direction of the recording material P is the same as the front-rear direction of the apparatus, that is, the downstream side in the discharging direction is the front side, and the upstream side, which is the opposite direction of the discharging direction, is the rear side. The recording material P is discharged through the discharging port 80 disposed on the rear side of the apparatus, and is stacked on the discharged paper stacking portion 11*e*, which is located on the front side of the apparatus at a lower position than the discharging port 80, hence in this configuration, the user who performs operation from the front side of the apparatus can easily collect the recording material P.

Figure 2B:
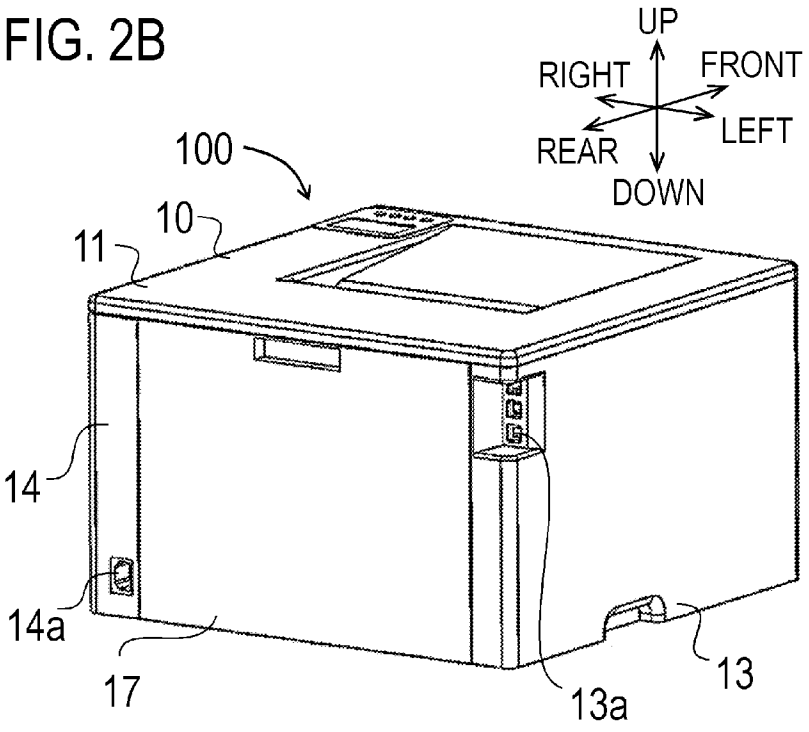
FIGS. 2A and 2B are perspective views of the image forming apparatus according to Embodiment 1.
Figure 2A:
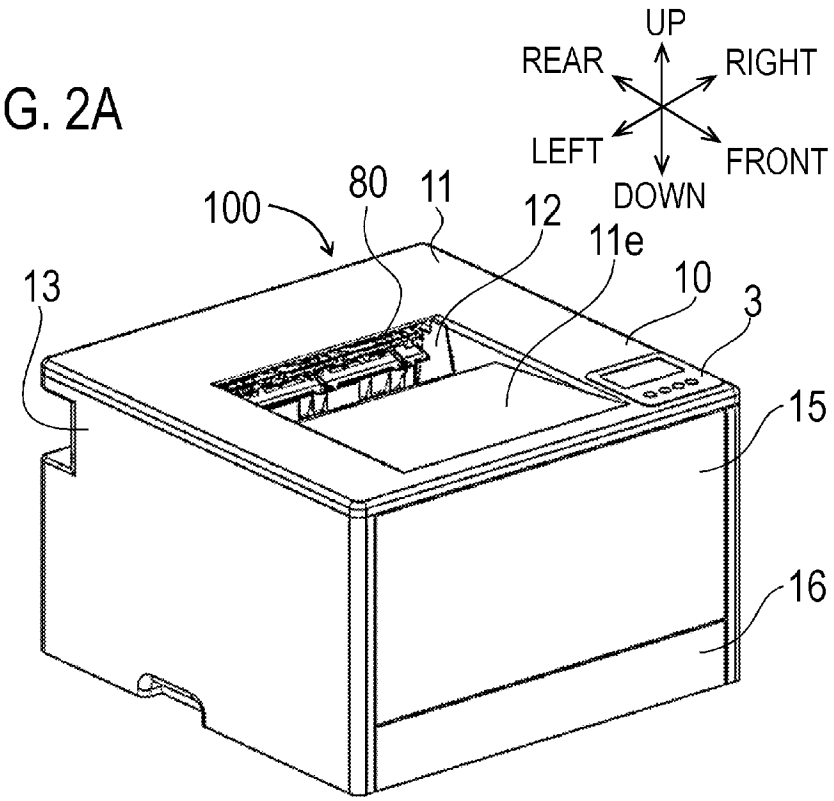

FIG. 2A is a perspective view of the image forming apparatus 100 according to Embodiment 1 of the present invention viewed from the apparatus front side, and FIG. 2B is a perspective view thereof viewed from the apparatus rear side. The image forming apparatus 100 is covered by a cover 10, which is a housing constituted of a plurality of members made of resin. In Embodiment 1, the cover 10 is constituted of an upper cover 11, a paper discharging cover 12, a left cover 13, a right cover 14, a front door 15, a cassette cover 16, and a rear door 17. The upper cover (top cover) 11 covers the top face side of the apparatus, and printed recording material is stacked on the discharged paper stacking portion 11*e* of the upper cover 11 via the discharging port 80 covered by the paper discharging cover 12. On the upper cover 11, an operation instructing portion 3, which includes buttons for the user to instruct operation of the printer and a monitor to display the operation state of the apparatus, is disposed as an operation portion. In the configuration of Embodiment 1, the user operates the apparatus from the front side of the apparatus, hence the operation instructing portion 3 is disposed on the front side of the apparatus, and the text to be displayed and the arrangement of the buttons are also designed based on the assumption that the user operates the operation instructing portion 3 from the front side. The front side of the apparatus is covered by the front door 15 and the cassette cover 16.

The front door 15 is supported to be openable from the image forming apparatus 100, so that such consumables as toner cartridges can be replaced. The cassette cover 16 is fixed to the feeding cassette 51, and is supported so as to be withdrawable integrally with the feeding cassette 51 from the image forming apparatus main unit. By withdrawing the feeding cassette 51 from the image forming apparatus 100, the user can replace or replenish the recording material P. Embodiment 1 has a configuration for the user to operate the apparatus from the apparatus front side, and the feeding cassette 51 can be withdrawn toward the apparatus front side. In other words, the inserting/withdrawing direction of the feeding cassette 51 is the same as the front-rear direction of the apparatus, and the downstream side in the withdrawing direction of the feeding cassette 51 corresponds to the front side of the apparatus. The left cover 13 covers the left side face of the image forming apparatus 100, where an external connector portion 13*a*, to which a communication line from the outside (e.g. USB, wireless LAN) can be connected, is disposed on the apparatus rear side. The external connector portion 13*a* of Embodiment 1 includes a USB connector and a LAN connector, but may include other connectors. The right cover 14 covers the right side face of the image forming apparatus 100, where a power supply connector portion 14*a* is disposed on the apparatus rear side. The rear door 17 is supported to be openable from the image forming apparatus 100, so that a paper jam can be cleared and consumables can be replaced. The cover 10 may be constituted of more members, or may be one integrally formed component.

(2) Positional Configuration of Wireless LAN Module 30

Figure 3:
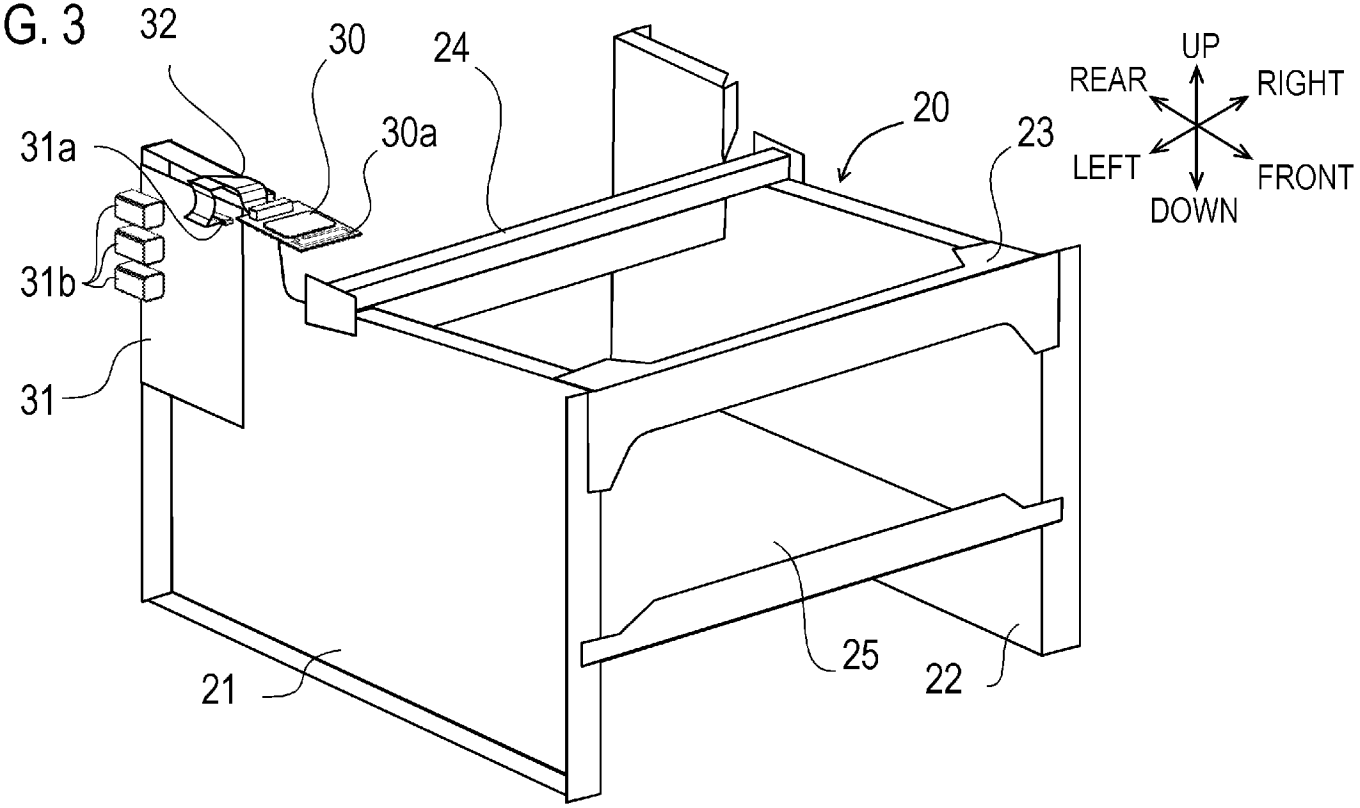
FIG. 3 is a perspective view inside the image forming apparatus according to Embodiment 1.

A positional relationship of a metal frame 20, a wireless LAN module 30 and a control board 31 according to Embodiment 1 will be described with reference to FIGS. 3 and 4. FIG. 3 is a perspective view of an internal configuration of the image forming apparatus 100 according to Embodiment 1, where only major components are indicated without the cover 10. The frame 20 is disposed vertically, and includes a left frame (first metal side plate) 21 and a right frame (second metal side plate) 22, which are a pair of side plates facing each other. The frame 20 also includes a front frame 23, a rear frame 24 and a lower frame 25, which are disposed between the left frame 21 and the right frame 22. The front frame 23, the rear frame 24 and the lower frame 25 are disposed in a direction orthogonal to the surfaces of the left frame 21 and the right frame 22, so as to connect the left frame 21 and the right frame 22. The left frame 21 and the right frame 22 extend horizontally from one end (front end) to the other end (rear end) of the apparatus along the front-rear direction of the apparatus, and are disposed to face each other across an image forming portion to form images and a discharging port 80 to discharge a recording material P to the outside. The configuration of the frame to implement the effect of the present invention is not limited to the present configuration, and may be modified in various ways.

The control board 31, to control the operation of the image forming apparatus 100, is installed on the left frame 21. The control board 31 may be installed on the left frame 21 directly or installed via a mounting metal plate. The wireless LAN module 30, which is a wireless communication board, includes an antenna 30*a*, and is held on the upper cover 11. The wireless LAN module 30 receives predetermined instructions, such as printing and setting, from an external device via wireless LAN communication. The instruction received by the wireless LAN module 30 is transferred to the control board 31 via a flat cable 32 connected to a connector 31*a*. The control board 31 processes external information received by the wireless LAN module 30, and sends the external information to a transmitting portion of the image forming apparatus 100. The control board 31 includes a connector for external connection 31*b*. For the wireless LAN module, a Wi-Fi module, for example, can be used. The positional relationships of the wireless LAN module 30 and other components, which is a configuration characterizing the present invention, will be described later.

Figure 4:
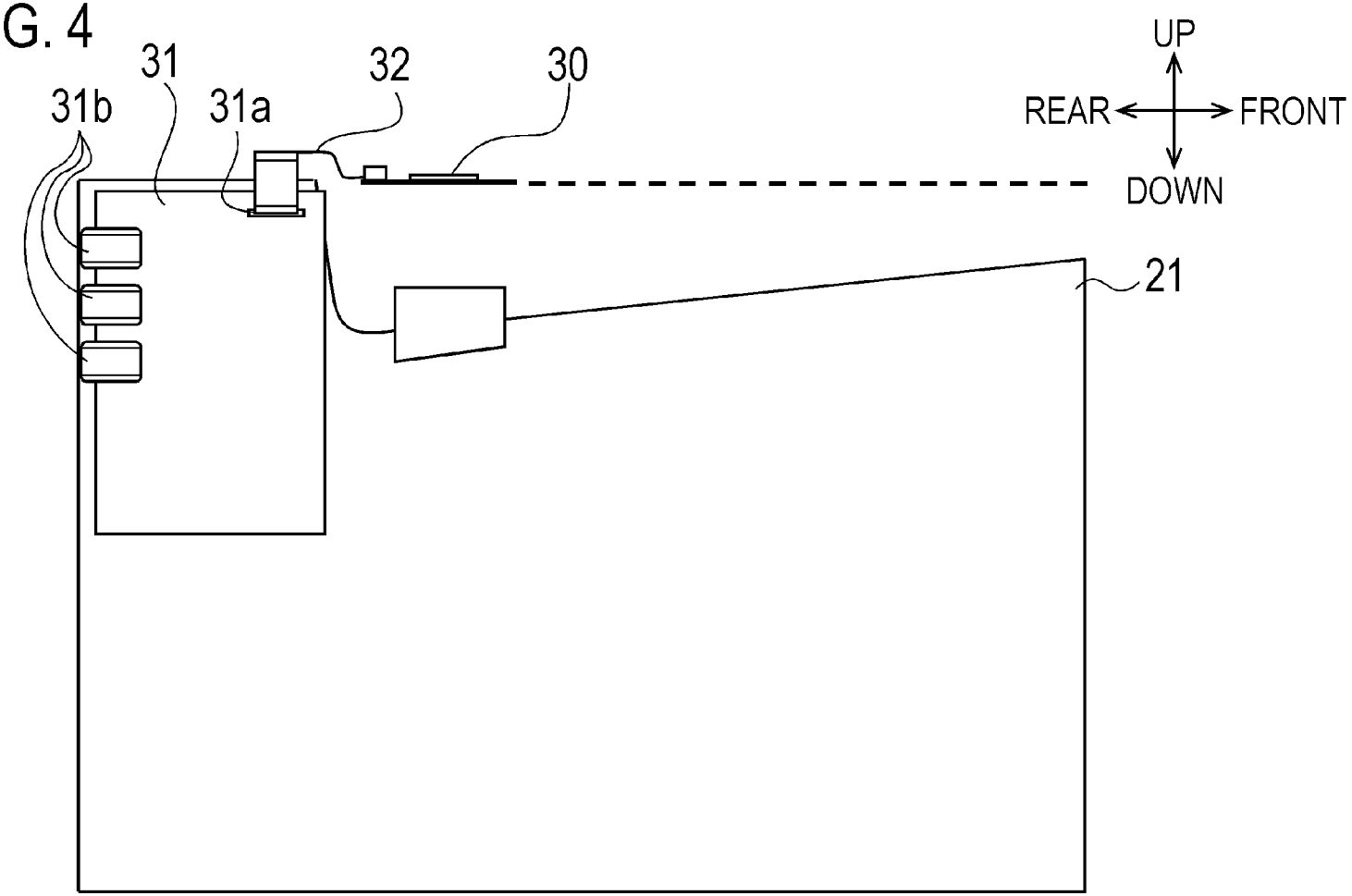
FIG. 4 is a left side view inside the image forming apparatus according to Embodiment 1.

FIG. 4 is a left side view of the internal configuration of the image forming apparatus 100 according to Embodiment 1, where only major components are indicated without the cover 10. In order to stack the recording material P, which is discharged from the apparatus rear side to the apparatus front side, onto the discharged paper stacking portion 11*e*, the left frame 21 is formed such that the rear side of the apparatus, where the discharging port 80 is disposed, is located at a position higher than the apparatus front side where the discharged paper stacking portion 11*e* is disposed. In other words, the front side of the left frame 21 extends inclined, so that the height gradually decreases from the apparatus front side to the apparatus rear side, and the rear side of the left frame 21 extends horizontally at a position that is vertically higher than the upper end of the inclined portion on the front side of the left frame 21, and is located on the rear side in the horizontal direction. The right frame 22 is formed in the same way as the left frame 21.

The positional relationship of the wireless LAN module 30 and the frame 20 according to Embodiment 1 will be described in detail. The wireless LAN module 30 is held on the upper cover 11. The wireless LAN module 30 is disposed such that the upper end of the left frame 21 in a region on the apparatus front side with respect to the wireless LAN module 30, is located at a position vertically lower than the wireless LAN module 30. Other components constituting the frame 20, such as the right frame 22 and the front frame 23, are also located at positions lower than the wireless LAN module 30 in the region on the apparatus front side, just like the left frame 21. In other words, as indicated by the dotted line in FIG. 4, the frame 20 in the region on the apparatus front side with respect to the wireless LAN module 30 is located vertically at a position lower than the wireless LAN module 30. This configuration prevents a drop in communication performance in the apparatus front side with respect to the wireless LAN module 30, due to the use of the metal frame 20, hence good wireless communication performance can be ensured. This configuration is especially effective for image forming apparatuses similar to Embodiment 1, which is based on the assumption that the user performs operation and wireless communication from the apparatus front side. Furthermore, the wireless LAN module 30 is disposed such that the surface of the board faces in the vertical direction, which means that the height of the apparatus does not become unnecessarily high. As a result, if this configuration is used, the apparatus size need not be increased.

Next the positional relationship of the wireless LAN module 30 and the control board 31 according to Embodiment 1 will be described in detail. The control board 31 is disposed near the upper end of the left frame 21 on the rear side, and is connected to the wireless LAN module 30 via the flat cable 32 connected to the connector 31*a*. The control board 31 is disposed so as to overlap with the metal left frame 21, whereby noise resistance improves. The wireless LAN module 30 of the present embodiment is disposed at a position closer to the edge of the left frame 21 on the apparatus rear side than to the edge thereof on the apparatus front side, so as to be disposed at a position closer to the control board 31. Further, the rear side of the left frame 21 of the Embodiment 1 is formed to become higher than the front side, hence the control board 31 can be disposed at a position close to the wireless LAN module 30 even in the vertical direction as well. Since the short flat cable 32 can be used as a cable connecting portion to connect the control board 31 and the wireless LAN module 30, the connection operation becomes easy. Further, the short flat cable 32 increases noise resistance, which is advantageous in terms of wireless communication performance as well.

As described above, in order to ensure good wireless communication performance of the antenna 30*a* included in the wireless LAN module 30, the left frame 21 is located at a position lower than the wireless LAN module 30 in a region on the apparatus front side with respect to the wireless LAN module 30. The apparatus rear side of the left frame 21 is formed to be located at a position higher than the apparatus front side, and the wireless LAN module 30 and the control board 31 can be disposed close to each other, because the control board 31 disposed on the apparatus rear side is located higher. Because of this configuration, not only a drop in wireless communication performance due to the metal components but also a drop in wireless communication performance due to the use of the long cable connecting portion can be prevented at the same time.

(3) Support Portion of Upper Cover 11

Figure 5:
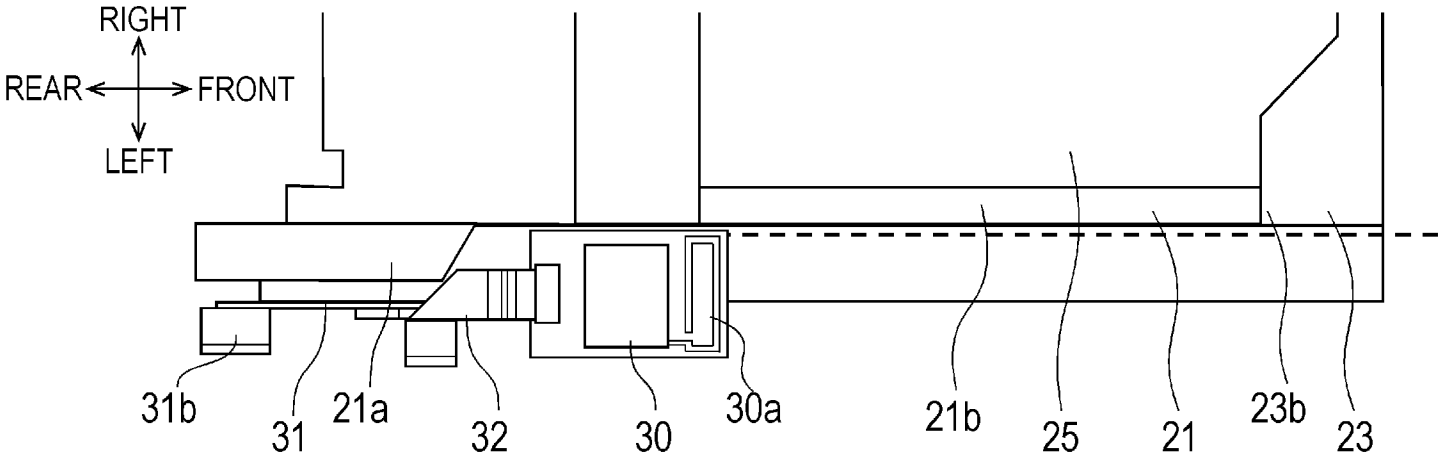
FIG. 5 is a top view inside the image forming apparatus according to Embodiment 1.

A support portion of the upper cover 11 according to Embodiment 1 will be described with reference to FIGS. 5 to 7. FIG. 5 is a top view of the internal configuration of the image forming apparatus 100 according to Embodiment 1, where only major components are indicated without the cover 10. In order to support the upper cover 11 made of resin, the left frame 21 includes a support surface 21*a* and a securing portion 21*b*, and the front frame 23 includes a support surface 23*b*. Similar support surfaces to the left frame 21 are also disposed on the right frame 22. The support surface 21*a* is located on the apparatus rear side with respect to the wireless LAN module 30, and the securing portion 21*b* and the support surface 23*b* are located on the apparatus front side with respect to the wireless LAN module 30.

Figure 6:
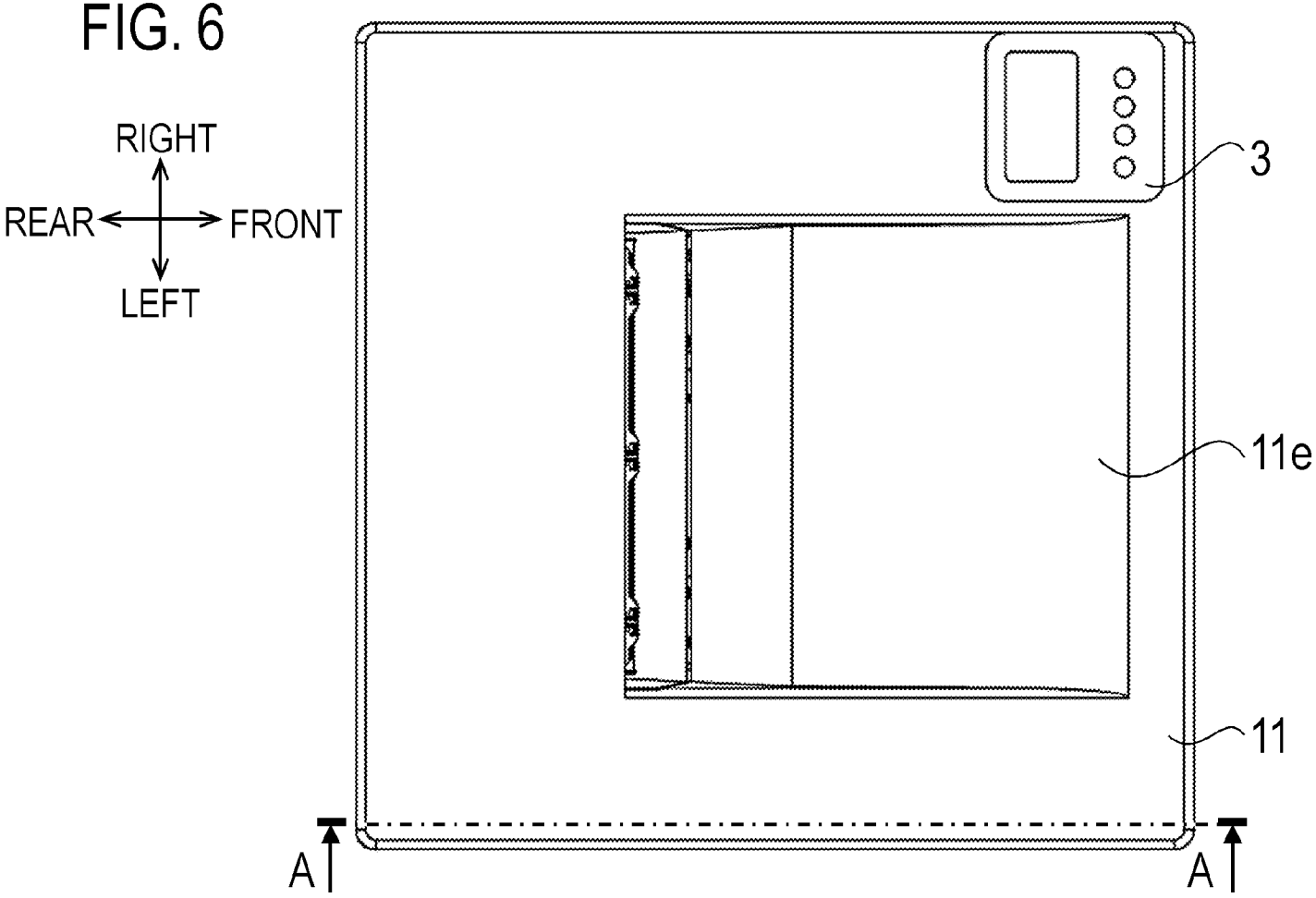
FIG. 6 is a top view of the image forming apparatus according to Embodiment 1.
Figure 7:
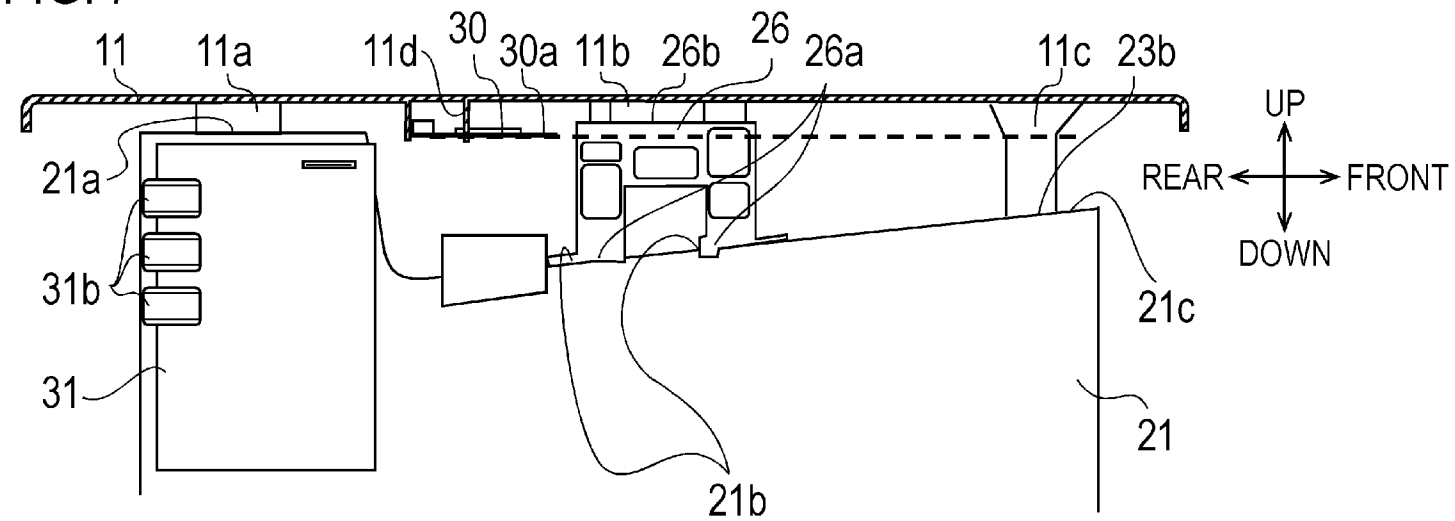
FIG. 7 is a cross-sectional view of the image forming apparatus according to Embodiment 1.

FIG. 6 is a top view of the image forming apparatus 100 according to Embodiment 1. FIG. 7 is a cross-sectional view at A-A in FIG. 6, where only major components of the image forming apparatus 100 according to Embodiment 1 are indicated. The upper cover 11 holds the wireless LAN module 30 using the wireless LAN module holding portion 11*d*. The upper cover 11 includes support portions 11*a*, 11*b* and 11*c*, which are made of resin and extend downward in the apparatus, and is supported on the frame 20 by the support portions 11*a*, 11*b* and 11*c*. In Embodiment 1, the support portions 11*a*, 11*b* and 11*c* are integrated with the upper cover 11, but may be secured to the upper cover 11 as separate members. The support portion 11*a* is disposed in a region on the apparatus rear side with respect to the wireless LAN module holding portion 11*d*, and contacts the support surface 21*a* of the left frame 21. Further, on the left frame 21, a support member 26, which is made of resin and includes a securing portion 26*a* and a support surface 26*b*, is secured by the securing portion 21*b*, and the support portion 11*b*, which is disposed on the apparatus front side with respect to the wireless LAN module holding portion 11*d*, contacts the support surface 26*b*. A support member 26 includes an opening portion through which a flat cable passes, and engages with the left frame 21, so as to support the upper cover 11, and partially contributes to holding the flat cable. Furthermore, the left frame 21 is connected with the front frame 23 by a connecting portion 21*c*, and the support portion 11*c* contacts the support surface 23*b* of the front frame 23. This configuration is also the same in the apparatus right side. In other words, the upper cover 11 is supported by the left frame 21 and the right frame 22 directly or via another member. Since the upper cover 11 is supported on the frame 20 by a plurality of support portions, load is distributed, and the upper cover 11 can be stably supported.

In the region on the apparatus front side with respect to the wireless LAN module 30, the securing portion 21*b* and the support surface 23*b* are disposed at positions lower than the wireless LAN module 30, and the upper cover 11 is supported by the frame 20 via the support portions. The support portions 11*a*, 11*b* and 11*c* of the upper cover 11 and the support member 26 are made of resin, which can suppress a drop in wireless communication performance compared with the case of a metal frame that is disposed at the same height as the antenna 30*a*. In other words, a good communication performance of the apparatus can be maintained, since the securing portion 21*b* and the support surface 23*b*, which are located on the apparatus front side with respect to the wireless LAN module 30, are both disposed at positions lower than the wireless LAN module 30. Because of this configuration, good communication performance can be ensured while supporting the upper cover 11 with the metal frame.

In the present embodiment, the "apparatus front side" means the downstream side in the discharging direction of the recording material P, the withdrawing side in the inserting/withdrawing directions of the feeding cassette 51, or the side on which the operation instructing portion 3 is disposed (second end side) in the direction where the left frame 21 extends horizontally. The "apparatus rear side" means the side on which the control board 31 is disposed (first end side) in the direction where the left frame 21 extends horizontally. In other words, the apparatus is configured based on the assumption that the user performs each of such an operation as collecting the recording material P, withdrawing the feeding cassette 51, and operating the operation instructing portion 3 in a position facing the front side of the apparatus. On the other hand, components which are not usually operated, such as the control board 31 having the connector for external connection 31*b*, are disposed on the apparatus rear side.

In terms of the wireless communication performance alone, a drop in the wireless communication performance can be suppressed if the entire frame is made of resin, for example. However a resin frame is not as rigid as the case of using a metal frame, and is not very reliable to support the image forming portion and the discharging port 80. An advantage of the configuration of the present invention is that rigidity of the apparatus is ensured using the metal frame, while a drop in the wireless communication performance due to the use of a metal component is prevented, and good wireless communication performance is ensured. In other words, in a region on the apparatus front side with respect to the wireless LAN module 30, the upper end of the frame 20 is located lower than the wireless LAN module 30, whereby the image forming apparatus that can ensure good communication performance can be provided while maintaining rigidity of the apparatus.

Embodiment 2

A configuration of an image forming apparatus 200 according to Embodiment 2 of the present invention will be described next with reference to FIGS. 8A and 8B to FIG. 11. A same composing element as Embodiment 1 is denoted with a same reference sign, and description thereof will be omitted.

Figure 8B:
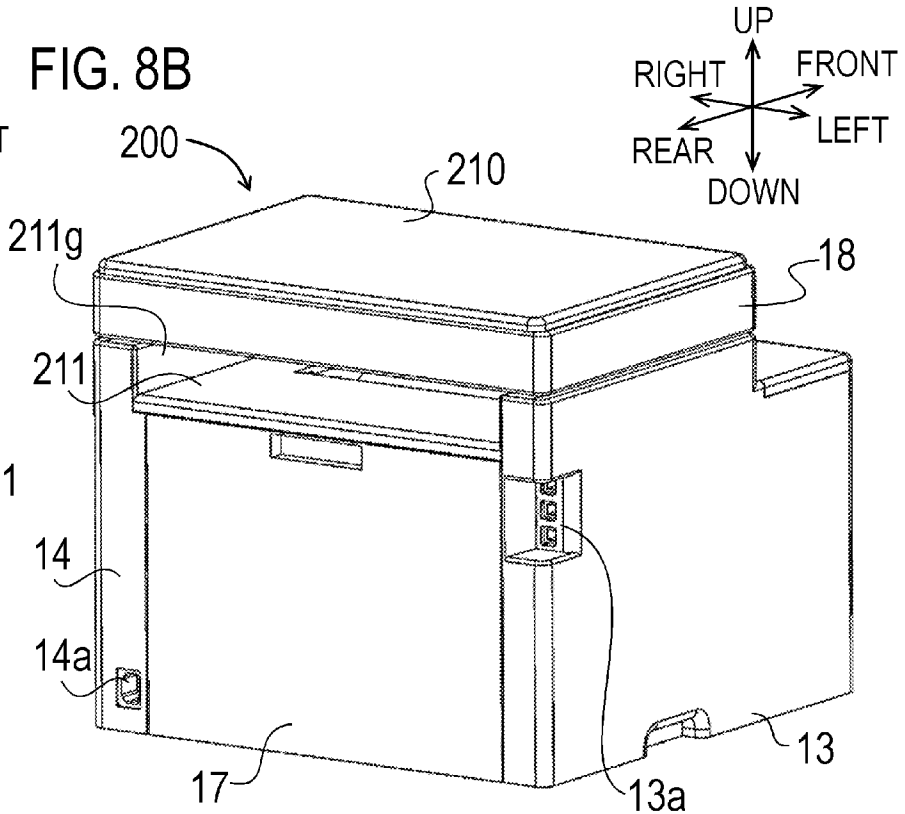
FIGS. 8A and 8B are perspective views of an image forming apparatus according to Embodiment 2.
Figure 8A:
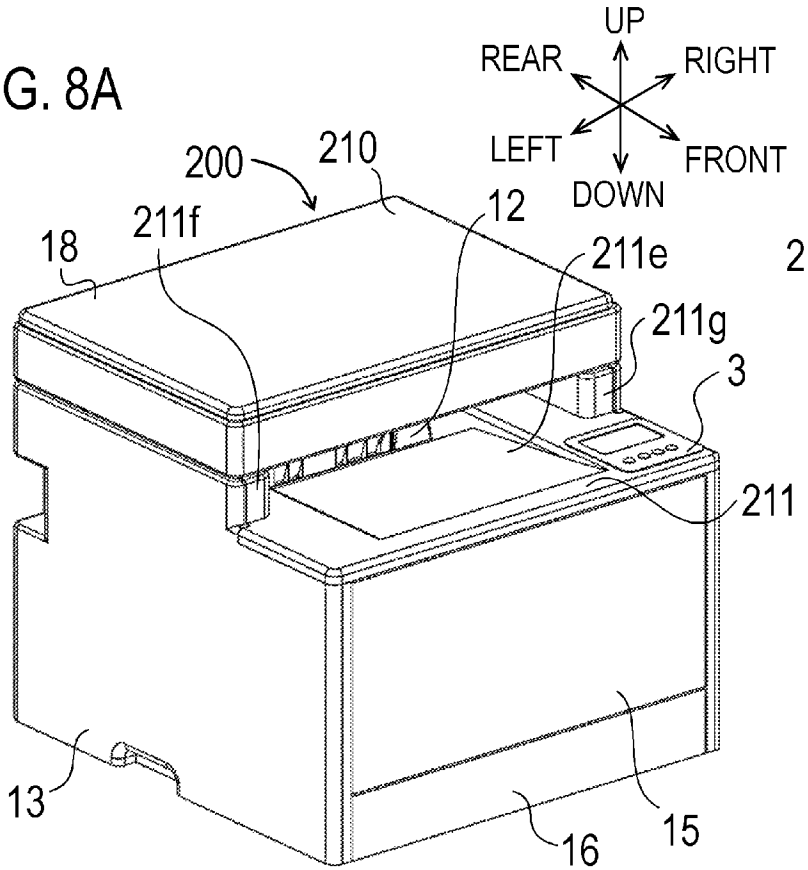

FIG. 8A is a perspective view of the image forming apparatus 200 according to Embodiment 2 of the present invention viewed from the apparatus front side, and FIG. 8B is a perspective view thereof viewed from the apparatus rear side. The image forming apparatus 200 is covered by a cover 210, which is an exterior constituted of an upper cover 211, the paper discharging cover 12, the left cover 13, the right cover 14, the front door 15, the cassette cover 16 and the rear door 17, and an original reading portion 18 is disposed above the upper cover 211. In the original reading portion 18, the image forming apparatus can read an image, such as an original provided by the user. The read image can be uploaded for printing, or as electronic data. The upper cover 211 covers the top face side of the apparatus, and printed recording material is stacked on the discharged paper stacking portion 211*e* of the upper cover 211 via the discharging port 80 covered by the paper discharging cover 12. The upper cover 211 further includes reading portion support portions 211*f* and 211*g* on the left and right sides thereof, so as to support both ends of the original reading portion 18.

Figure 9:
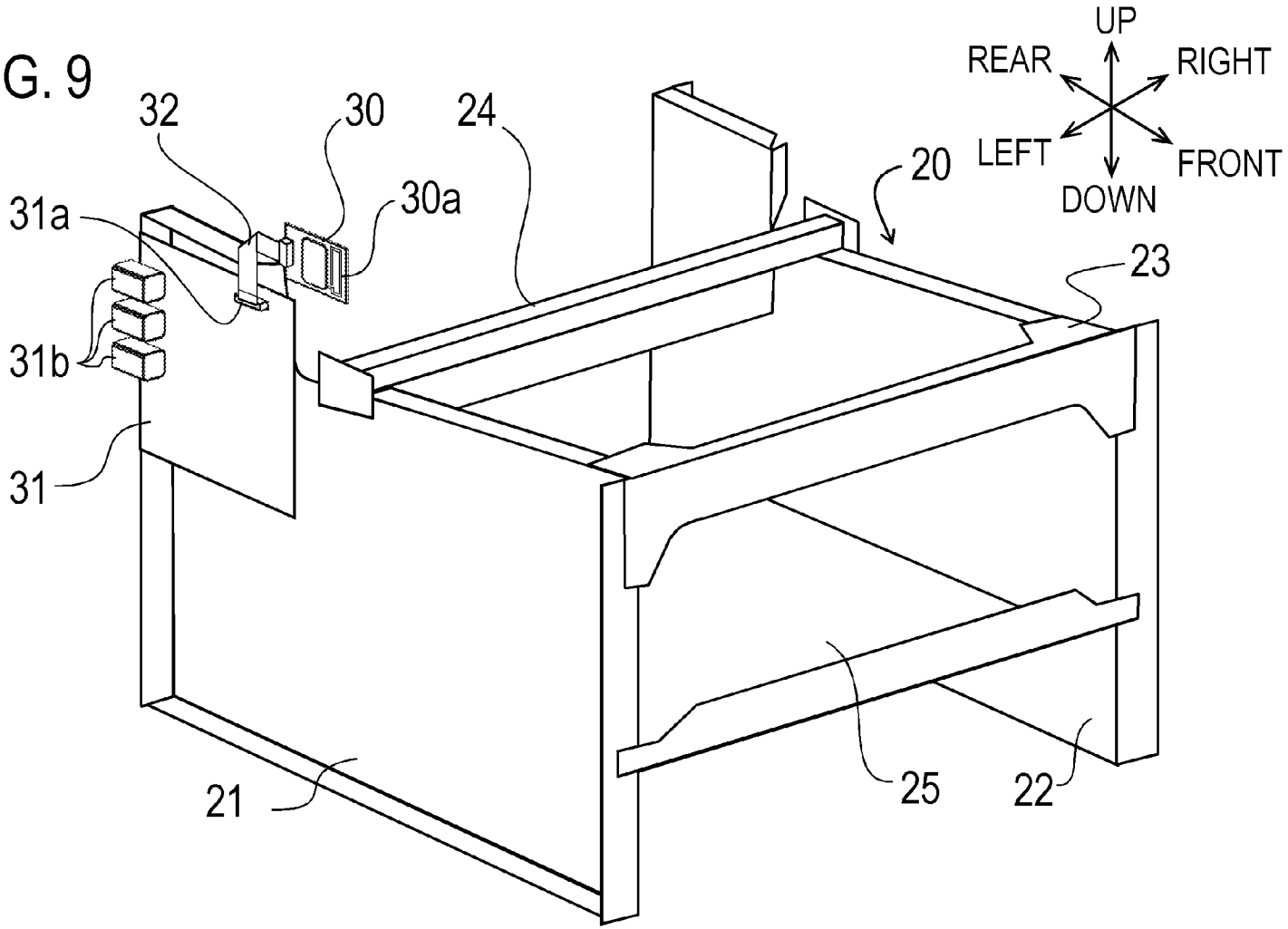
FIG. 9 is a perspective view inside the image forming apparatus according to Embodiment 2.
Figure 10:
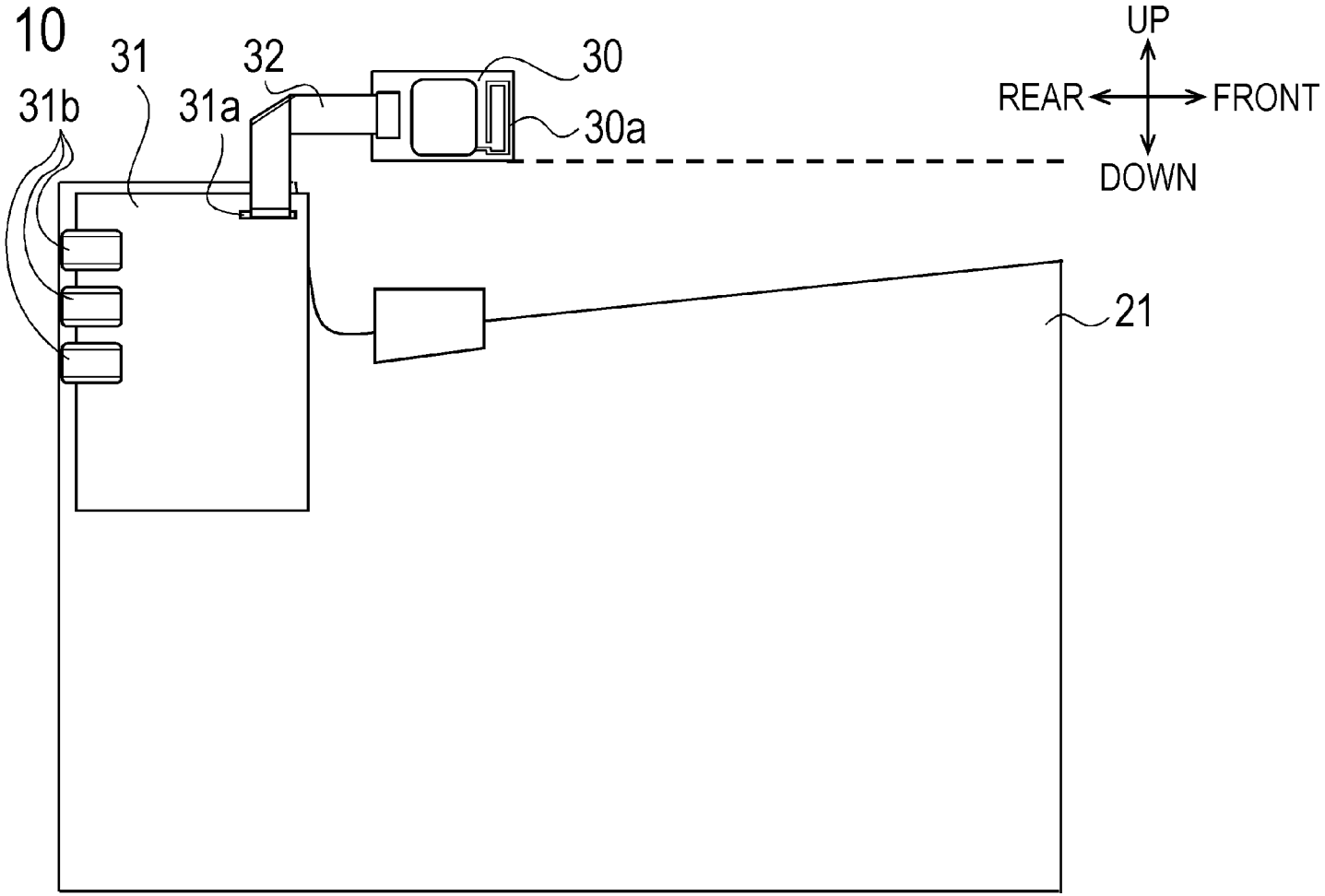
FIG. 10 is a left side view inside the image forming apparatus according to Embodiment 2.

A positional relationship of the metal frame 20, the wireless LAN module 30, and the control board 31 according to Embodiment 2 will be described with reference to FIGS. 9 and 10. FIG. 9 is a perspective view of an internal configuration of the image forming apparatus 200 according to Embodiment 2, where only major components are indicated without the cover 210. The frame 20 is constituted of the left frame 21, the right frame 22, the front frame 23, the rear frame 24 and the lower frame 25, just like Embodiment 1, and the left frame 21 and the right frame 22 are connected by the front frame 23, the lower frame 25 and the rear frame 24. The wireless LAN module 30 is held on the upper cover 211, and is connected to the control board 31 installed on the left frame 21 via the flat cable 32.

The positional relationship of the wireless LAN module 30 and the frame 20 according to Embodiment 2 will be described in detail. FIG. 10 is a left side view of the internal configuration of the image forming apparatus 200 according to Embodiment 2, where only major components are indicated without the cover 210. The wireless LAN module 30 is held on the upper cover 211. The wireless LAN module 30 is disposed such that an upper end of the left frame 21 in a region on the apparatus front side with respect to the wireless LAN module 30 is located at a position vertically lower than the wireless LAN module 30. Other components constituting the frame 20, such as the right frame 22 and the front frame 23, are also located at positions lower than the wireless LAN module 30 in the region on the apparatus front side, just like the left frame 21. In other words, as indicated by the dotted line in FIG. 10, the frame 20 in the region on the apparatus front side with respect to the wireless LAN module 30 is located vertically at a position lower than the wireless LAN module 30. This configuration prevents a drop in the communication performance on the apparatus front side of the wireless LAN module 30, due to the use of the metal frame 20, hence good wireless communication performance can be ensured. This configuration is especially effective for image forming apparatuses similar to Embodiment 2, which is based on the assumption that the user performs operation and wireless communication from the apparatus front side. Furthermore, the wireless LAN module 30 according to Embodiment 2 is disposed such that the surface of the board is parallel with the surface of the left frame 21, in order to prevent interference between the wireless LAN module 30 and the reading portion support portion 211*f*. In other words, the wireless LAN module 30 is disposed adjacent to the reading portion support portion 211*f* of the upper cover 211, and various components are disposed such that the size of the apparatus does not become unnecessarily large. As a result, if this configuration is used, the apparatus size need not be increased.

Next the positional relationship of the wireless LAN module 30 and the control board 31 according to Embodiment 2 will be described in detail. In Embodiment 2 as well, the control board 31 is disposed near the upper end of the left frame 21 on the rear side, and is connected to the wireless LAN module 30 via the flat cable 32 connected to the connector 31*a*. Since the short flat cable 32 can be used to connect the control board 31 and the wireless LAN module 30, the cable connecting portion becomes easy. Further, the short cable connecting portion increases noise resistance, hence this configuration is advantageous in terms of wireless communication performance as well.

Figure 11:
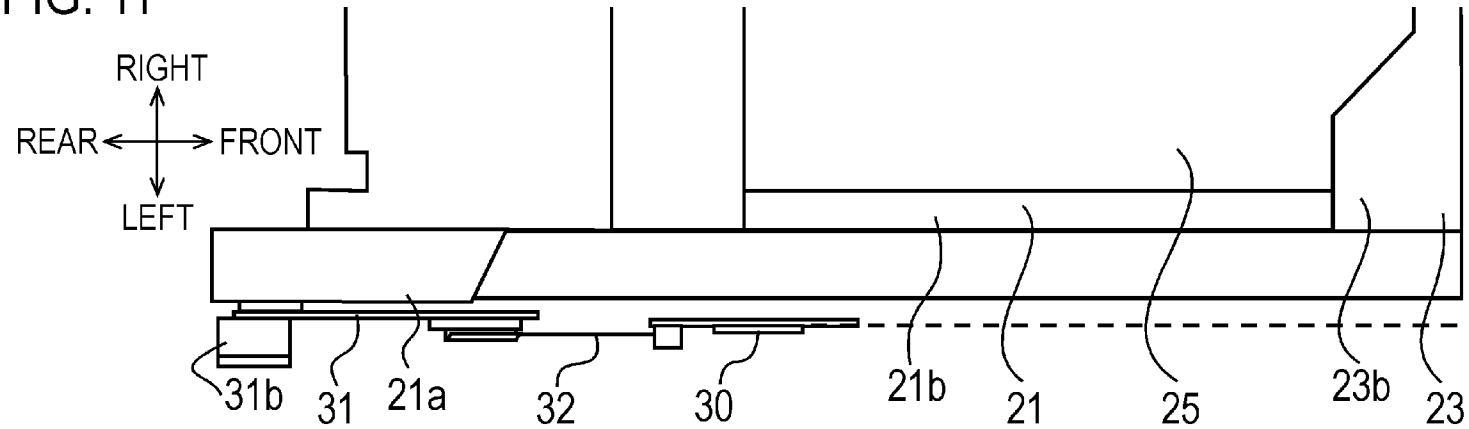
FIG. 11 is a top view inside the image forming apparatus according to Embodiment 2.

The support portion of the upper cover 211 according to Embodiment 2 will be described with reference to FIGS. 11 to 13. FIG. 11 is a top view of the internal configuration of the image forming apparatus 200 according to Embodiment 2, where only major components are indicated without the cover 210. In order to support the upper cover 211, the left frame 21 includes the support surface 21*a* and the securing portion 21*b*, and the front frame 23 includes the support surface 23*b*. Similar support surfaces to the left frame 21 are also disposed on the right frame 22. The support surface 21*a* is located on the apparatus rear side with respect to the wireless LAN module 30, and the securing portion 21*b* and the support surface 23*b* are located on the apparatus front side with respect to the wireless LAN module 30.

Figure 12:
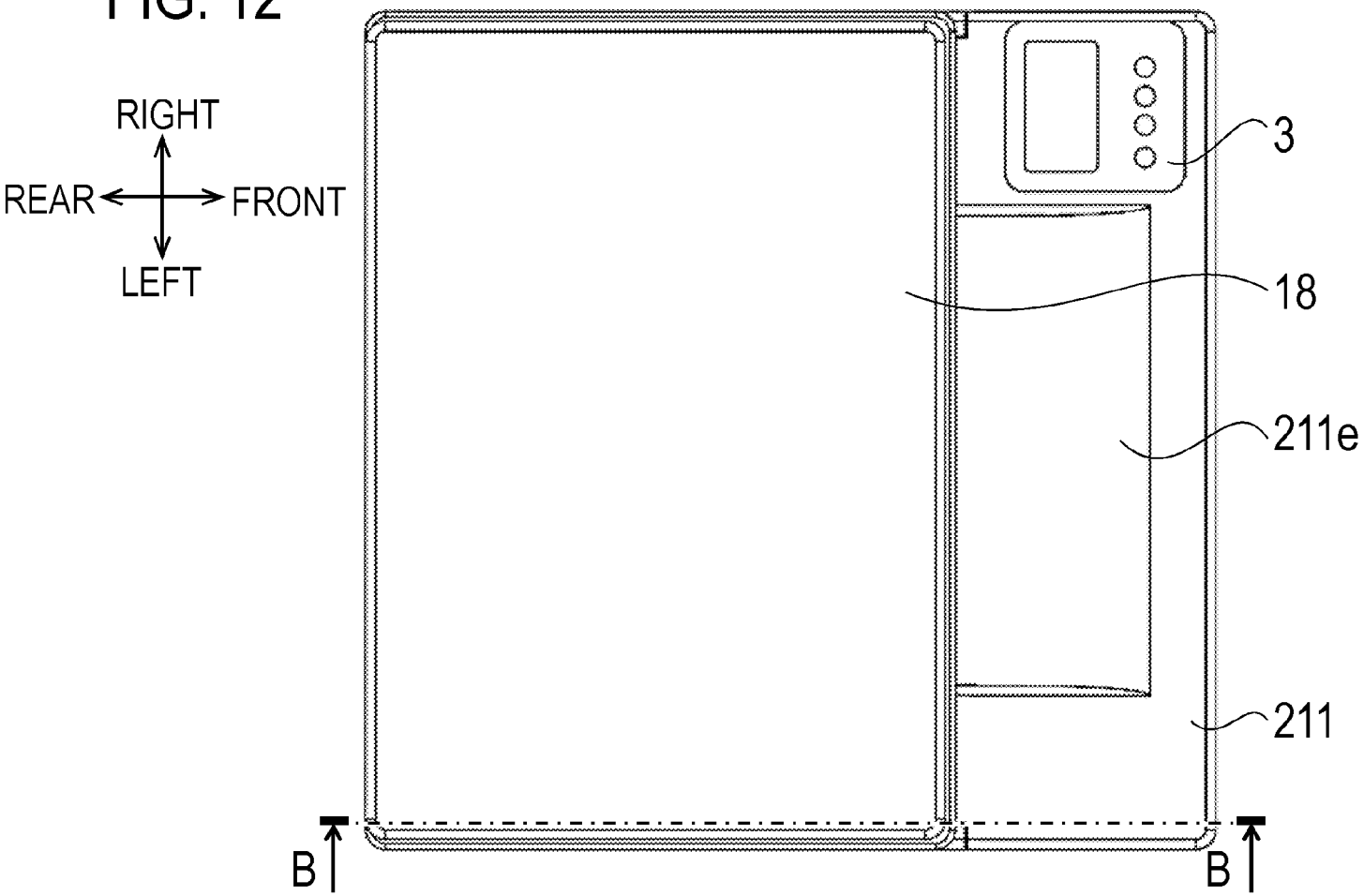
FIG. 12 is a top view of the image forming apparatus according to Embodiment 2.
Figure 13:
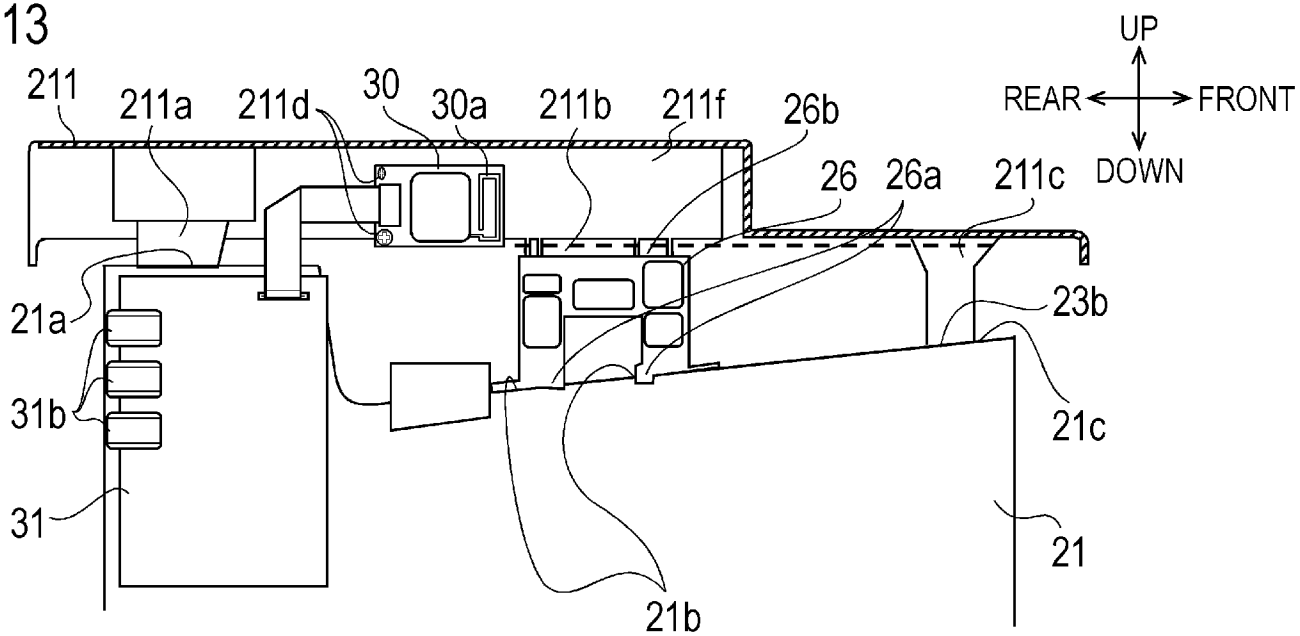
FIG. 13 is a cross-sectional view of the image forming apparatus according to Embodiment 2.

FIG. 12 is a top view of the image forming apparatus 200 according to Embodiment 2. FIG. 13 is a cross-sectional view at B-B in FIG. 12, where only major components of the image forming apparatus 200 according to Embodiment 2 are indicated. The upper cover 211 holds the wireless LAN module 30 using a wireless LAN module holding portion 211*d*. The upper cover 211 includes support positions 211*a*, 211*b* and 211*c*, which are made of resin and extend downward in the apparatus, and is supported on the frame 20 by the support portions 211*a*, 211*b* and 211*c*, just like Embodiment 1. In other words, the upper cover 211 is supported on the left frame 21 and the right frame 22 directly or via another member, such as the support member 26. In Embodiment 2, the support portions 211*a*, 211*b* and 211*c* are formed integrally with the upper cover 211, but may be secured to the upper cover 211 as separate members. The upper cover 211 of Embodiment 2 further includes the reading portion support portions 211*f* and 211*g*, and supports the original reading portion 18 disposed above.

In Embodiment 2 as well, in the region on the apparatus front side with respect to the wireless LAN module 30, the securing portion 21*b* and the support surface 23*b* are disposed at positions lower than the wireless LAN module 30, and the upper cover 211 is supported by the frame 20 via the support portions. The support portions 211*a*, 211*b* and 211*c* of the upper cover 211 and the support member 26 are made of resin, which can suppress a drop in the wireless communication performance compared with the case of a metal frame that is disposed at the same height as the antenna 30*a*. In other words, good communication performance of the apparatus can be maintained, since the securing portion 21*b* and the support surface 23*b*, which are located on the apparatus front side with respect to the wireless LAN module 30, are both disposed at positions lower than the wireless LAN module 30. Because of this configuration, good wireless communication performance can be ensured while supporting the upper cover 211 with the metal frame.

By the above configuration, even in Embodiment 2 which includes the original reading portion 18, the upper end of the frame 20 can be located at a position lower than the wireless LAN module 30 in the region on the apparatus front side with respect to the wireless LAN module 30. In other words, the image forming apparatus that can ensure good communication performance can be provided while maintaining rigidity of the apparatus.

Embodiment 3

A configuration of an image forming apparatus 300 according to Embodiment 3 of the present invention will be described next with reference to FIGS. 14A and 14B to FIG. 19. A same composing element as Embodiment 1 or Embodiment 2 is denoted with a same reference sign, and description thereof will be omitted.

Figure 14B:
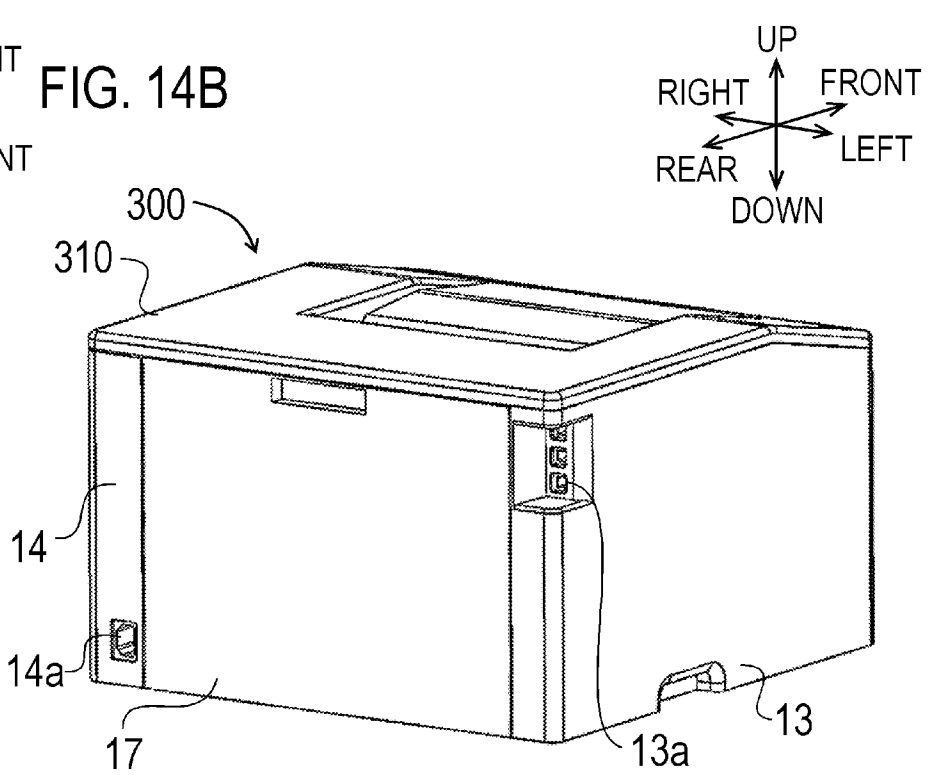
FIGS. 14A and 14B are perspective views of an image forming apparatus according to Embodiment 3.
Figure 14A:
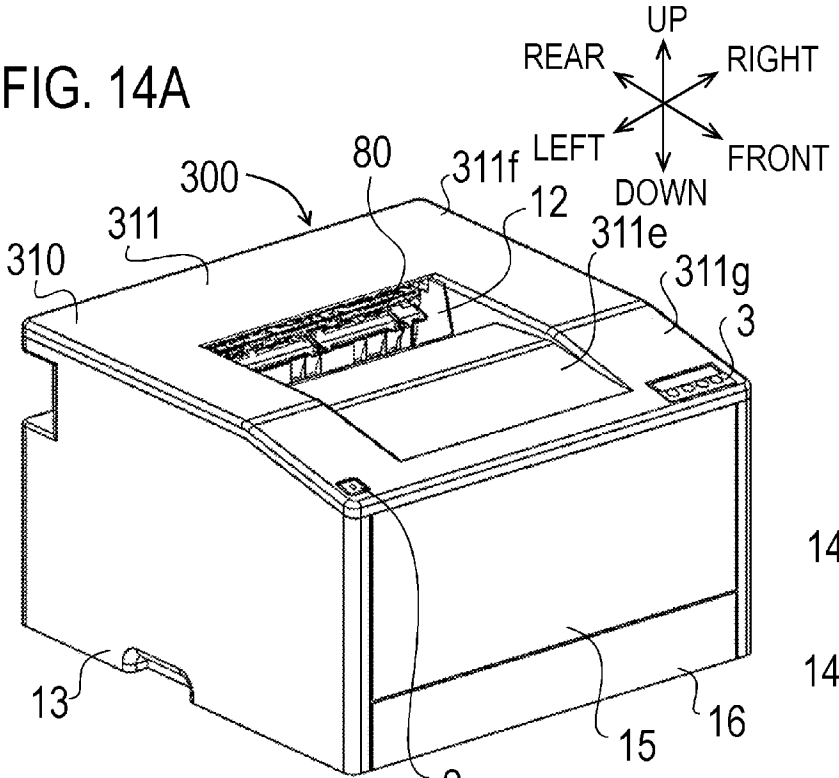

FIG. 14A is a perspective view of the image forming apparatus 300 according to Embodiment 3 of the present invention viewed from the apparatus front side, and FIG. 14B is a perspective view thereof viewed from the apparatus rear side. The image forming apparatus 300 is covered by a cover 310, which is an exterior constituted of an upper cover 311, the paper discharging cover 12, the left cover 13, the right cover 14, the front door 15, the cassette cover 16 and the rear door 17. The upper cover 311 covers the top face side of the apparatus, and printed recording material is stacked on a discharged paper stacking portion 311*e* of the upper cover 311 via the discharging port 80 covered by the paper discharging cover 12. The upper cover 311 includes a horizontal surface 311*f* and an inclined surface 311*g*, and the power switch 2 and the operation instructing portion 3 are disposed as an operation portion on the inclined surface 311*g* located on the apparatus front side. The user turns the power ON/OFF using the power switch 2 (switch portion), and operates the printer using the operation instructing portion 3 which includes operation buttons to instruct operation of the printer and a monitor to display the operation state of the apparatus.

Figure 15:
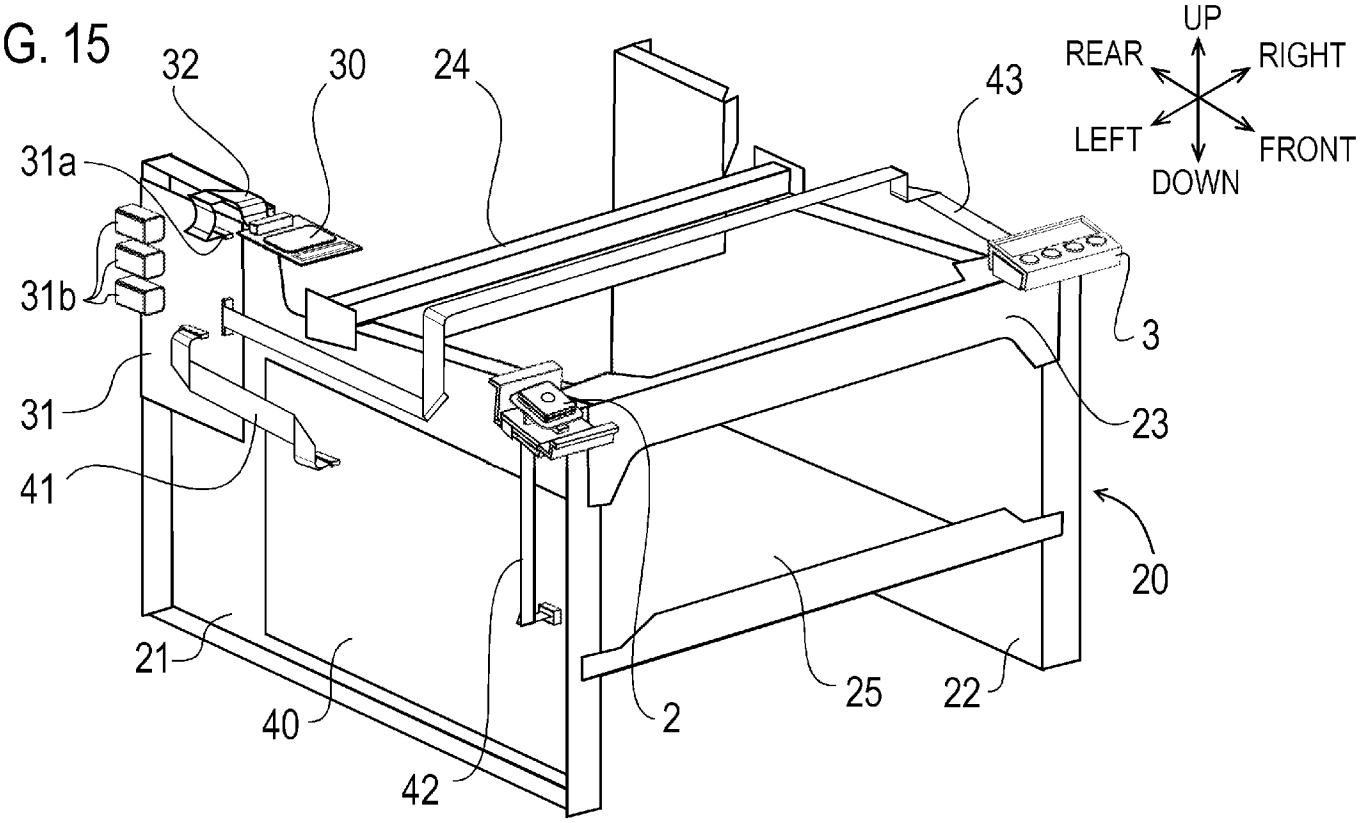
FIG. 15 is a perspective view inside the image forming apparatus according to Embodiment 3.
Figure 16:
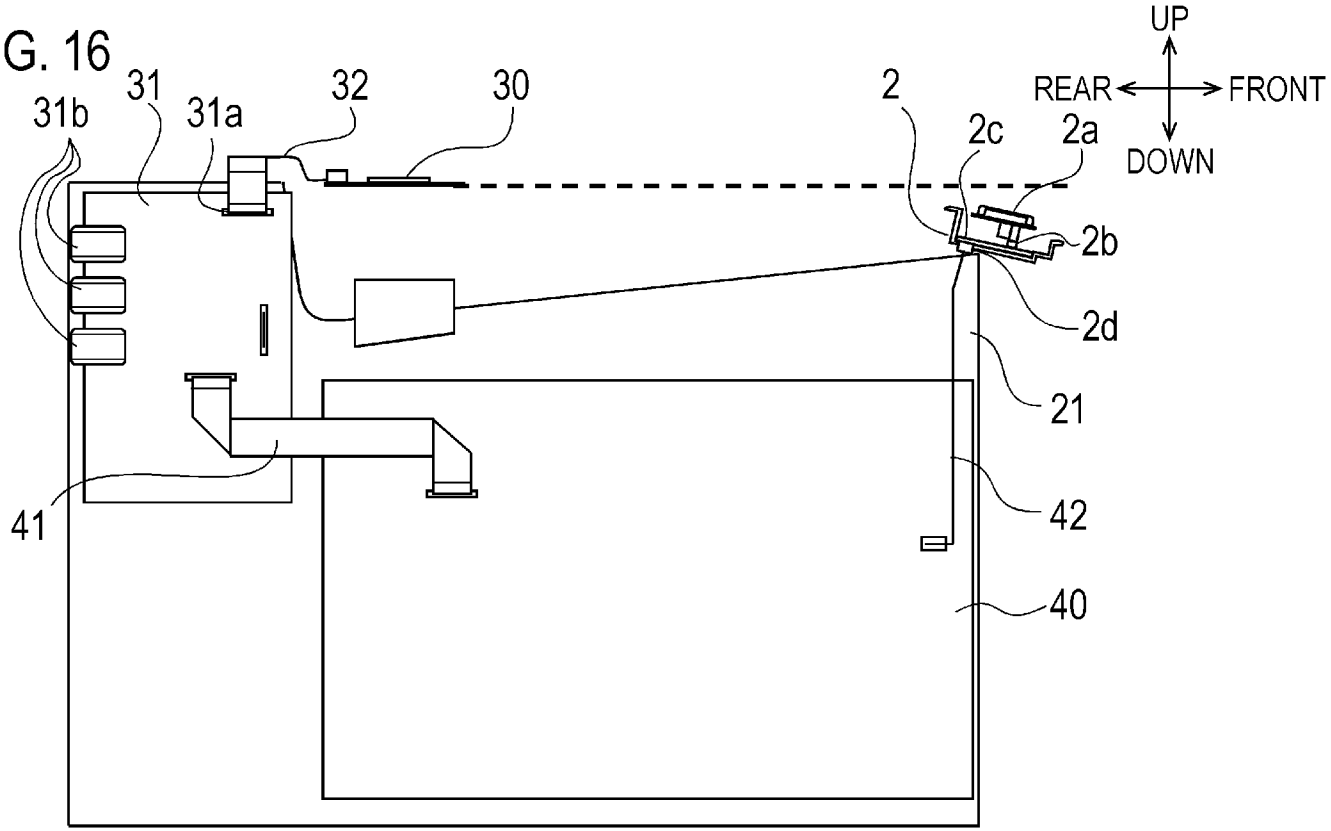
FIG. 16 is a left side view inside the image forming apparatus according to Embodiment 3.
Figure 17:
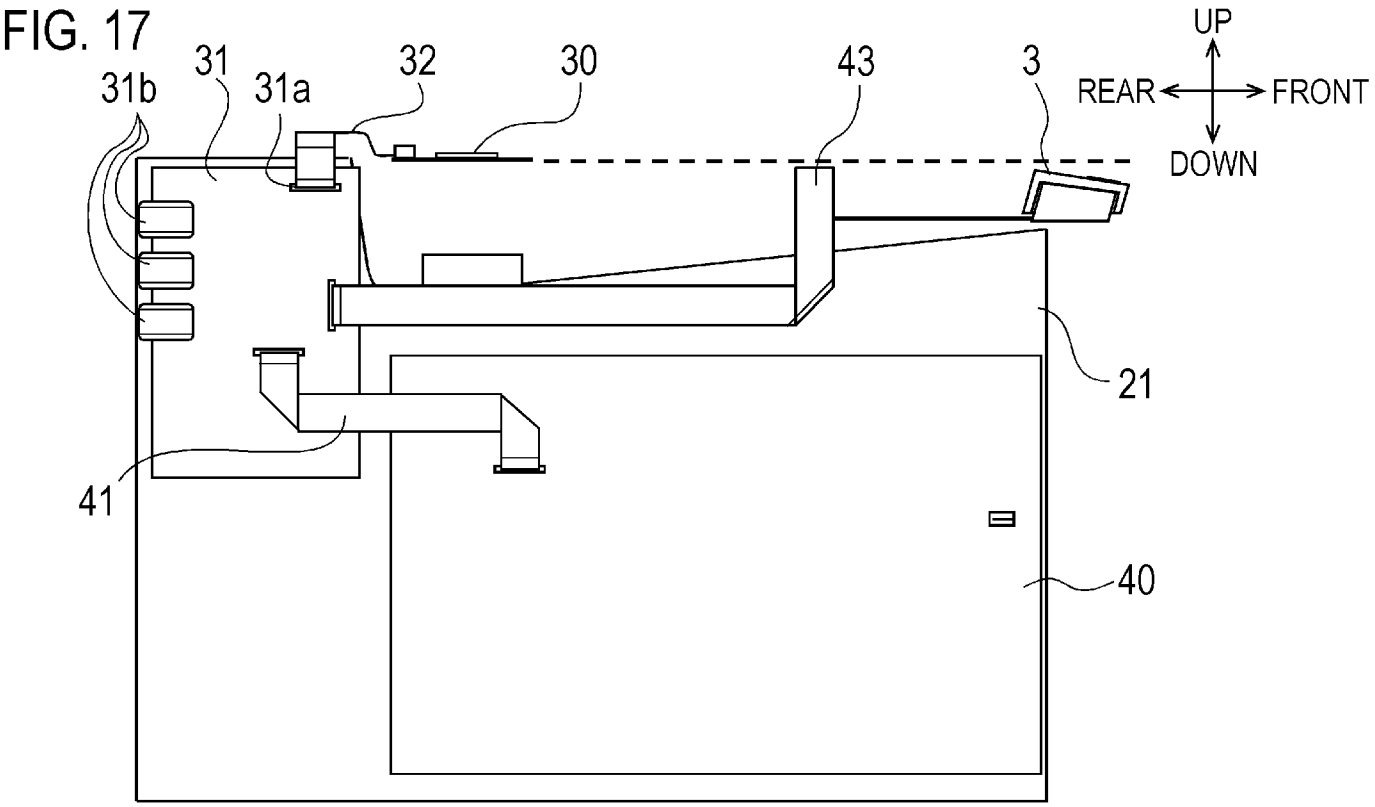
FIG. 17 is a left side view inside the image forming apparatus according to Embodiment 3.

A positional relationship of the frame 20, the wireless LAN module 30, the control board 31, the power switch 2 and the operation instructing portion 3 according to Embodiment 3 will be described with reference to FIGS. 15 to 17. FIG. 15 is a perspective view of an internal configuration of the image forming apparatus 300 according to Embodiment 3, where only major components are indicated without the cover 310. The frame 20 is constituted of the left frame 21, the right frame 22, the front frame 23, the rear frame 24 and the lower frame 25, just like Embodiment 1, and the left frame 21 and the right frame 22 are connected by the front frame 23, the lower frame 25 and the rear frame 24. The wireless LAN module 30 is held on the upper cover 211, and is connected to the control board 31 installed on the left frame 21 via the flat cable 32. In Embodiment 3, an intermediate control board 40 is installed on the left frame 21 in addition to the control board 31. The intermediate control board 40 is connected to the control board 31 via a flat cable 41, connected to the power switch 2 via a flat cable 42, and is connected to the operation instructing portion 3 via a flat cable 43. The types and routes of the connection lines are not limited to the present configuration, but may be modified in various ways.

The positional relationship of the wireless LAN module 30 and the frame 20 according to Embodiment 3 will be described in detail. FIG. 16 is a left side view of the internal configuration of the image forming apparatus 300 according to Embodiment 3, where only major components are indicated without the cover 310, and indicates the wireless LAN module 30 and the power switch 2. The wireless LAN module 30 is held on the upper cover 311. The wireless LAN module 30 is disposed such that an upper end of the left frame 21 in a region on the apparatus front side with respect to the wireless LAN module 30 is located at a position vertically lower than the wireless LAN module 30. Other components constituting the frame 20, such as the right frame 22 and the front frame 23, are also located at positions lower than the wireless LAN module 30 in the region on the apparatus front side, just like the left frame 21. In other words, as indicated by the dotted line in FIG. 16, the frame 20 in the region on the apparatus front side with respect to the wireless LAN module 30 is located at a position vertically lower than the wireless LAN module 30 in the vertical direction. This configuration prevents a drop in communication performance on the apparatus front side with respect to the wireless LAN module 30, due to the use of the metal frame 20, hence good wireless communication performance can be ensured. This configuration is especially effective for image forming apparatuses similar to Embodiment 3, which is based on the assumption that the user performs operation and wireless communication from the apparatus front side.

Next the positional relationship of the wireless LAN module 30 and the power switch 2 according to Embodiment 3 will be described in detail. In Embodiment 3, the power switch 2 is disposed in the region on the apparatus front side with respect to the wireless LAN module 30, and is positioned at a position vertically lower than the wireless LAN module 30. In other words, a drop in the communication performance of the wireless LAN module 30 in the front side of the apparatus, due to the presence of the power switch 2 which include metal components, is prevented. The power switch 2 is constituted of such components as a switch pressing portion 2*a*, a switch board 2*b*, a switch holder 2*c*, and a switch connector 2*d*. At least the switch board 2*b* and the switch connector 2*d* contain metal, hence it is particularly critical that these components are located at positions lower than the wireless LAN module 30.

Next the positional relationship of the wireless LAN module 30 and the operation instructing portion 3 according to Embodiment 3 will be described in detail. FIG. 17 is a left side view of the internal configuration of the image forming apparatus 300 according to Embodiment 3, where only major components are indicated without the cover 310, and indicates the wireless LAN module 30 and the operation instructing portion 3. In Embodiment 3, the operation instructing portion 3 is disposed in the region on the apparatus front side with respect to the wireless LAN module 30, and is located at a position vertically lower than the wireless LAN module 30. In other words, a drop in communication performance on the apparatus front side with respect to the wireless LAN module 30, due to the presence of the operation instructing portion 3 which includes metal components, is prevented. Further, the flat cable 43 connecting the operation instructing portion 3 and the control board 31 is also disposed at a position lower than the wireless LAN module 30, so as to prevent a drop in wireless communication performance on the apparatus front side.

Next the positional relationship of the wireless LAN module 30 and the control board 31 according to Embodiment 3 will be described in detail. In Embodiment 3 as well, the control board 31 is disposed near the upper end of the left frame 21 on the rear side, and is connected to the wireless LAN module 30 via the flat cable 32 connected to the connector 31*a*. Since the short flat cable 32 can be used to connect the control board 31 and the wireless LAN module 30, operation of connecting the cable connecting portion becomes easy. Further, the short cable connection portion increases noise resistance, which is advantageous in terms of wireless communication performance as well.

Figure 18:
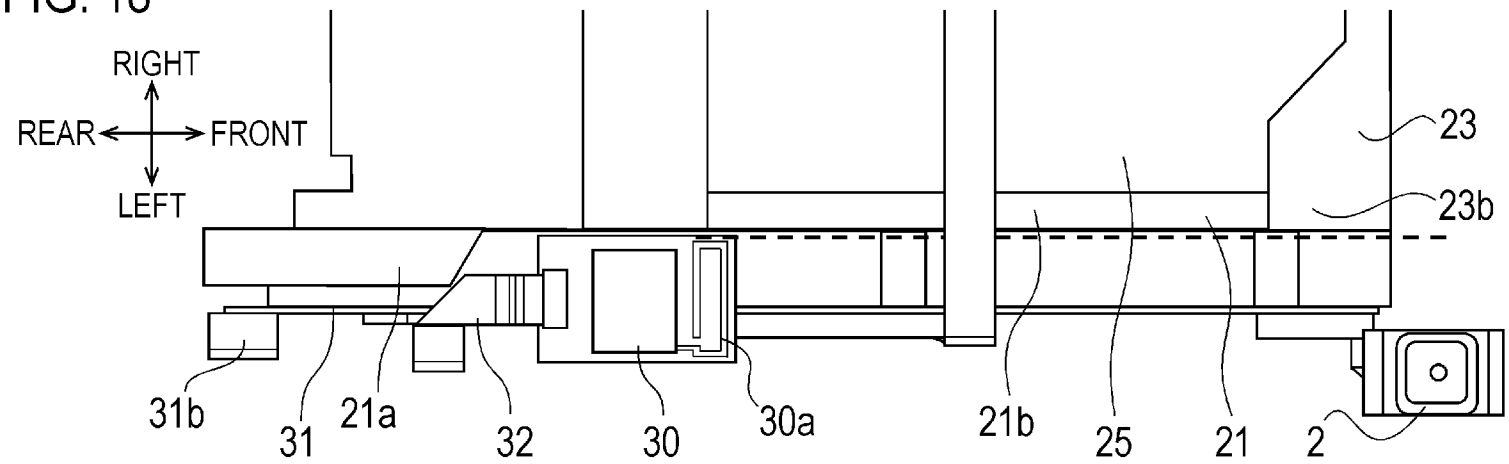
FIG. 18 is a top view inside the image forming apparatus according to Embodiment 3.

The support portion of the upper cover 311 according to Embodiment 3 will be described with reference to FIGS. 18 to 20. FIG. 18 is a top view of the internal configuration of the image forming apparatus 300 according to Embodiment 3, where only major components are indicated without the cover 310. In order to support the upper cover 311, the left frame 21 includes the support surface 21*a* and the securing portion 21*b*, and the front frame 23 includes the support surface 23*b*. Similar support surfaces to the left frame 21 are also disposed on the right frame 22. The support surface 21*a* is located on the apparatus rear side with respect to the wireless LAN module 30, and the securing portion 21*b* and the support surface 23*b* are located on the apparatus front side with respect to the wireless LAN module 30.

Figure 19:
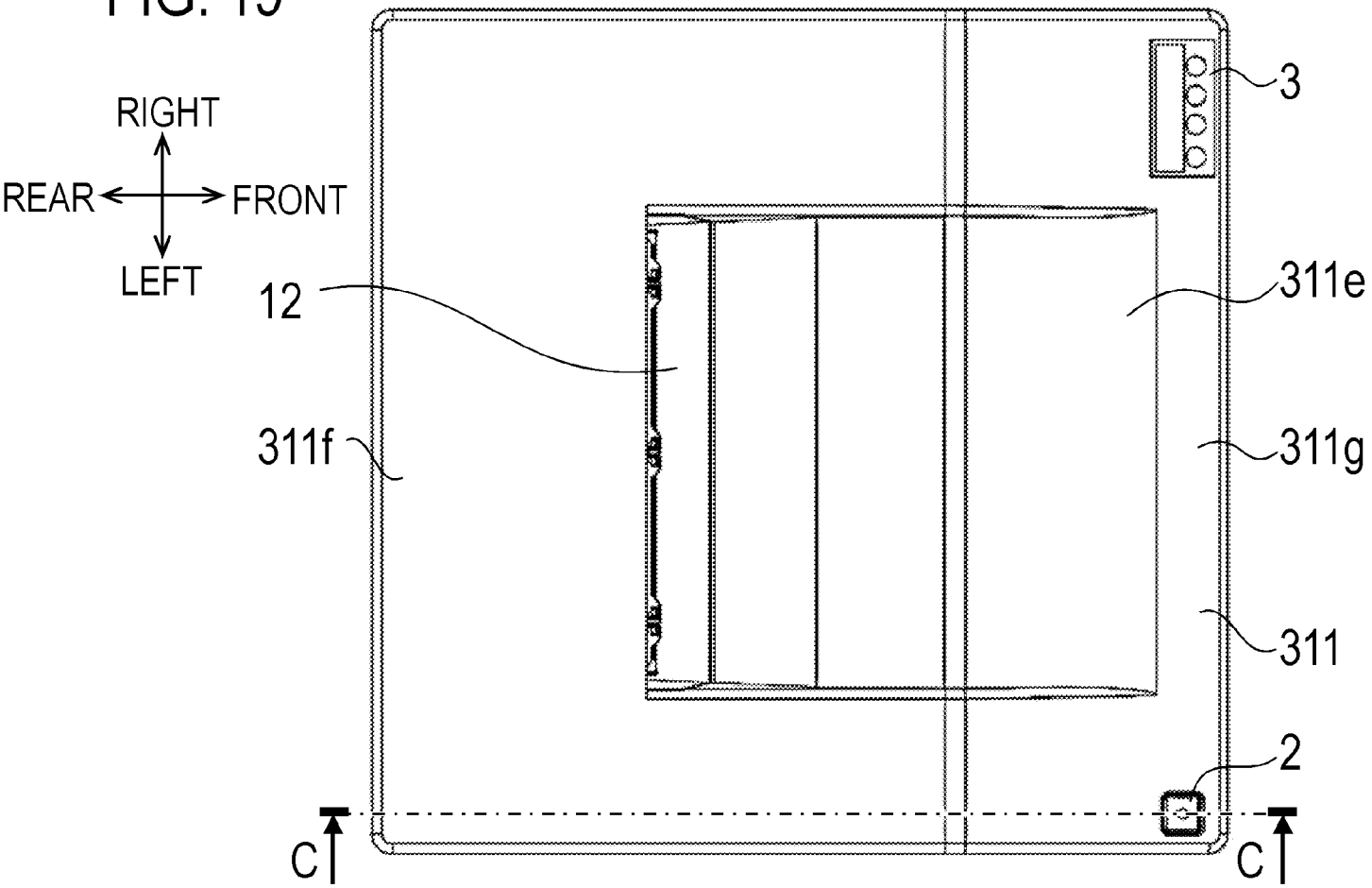
FIG. 19 is a top view of the image forming apparatus according to Embodiment 3.
Figure 20:
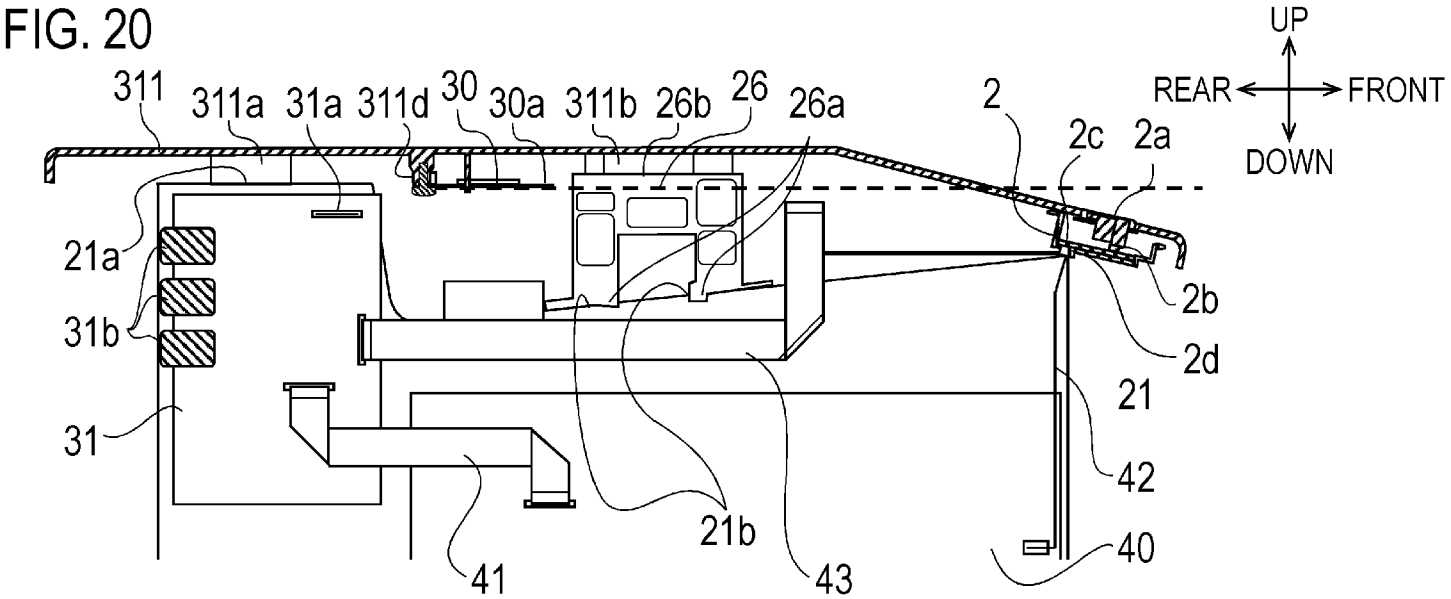
FIG. 20 is a cross-sectional view of the image forming apparatus according to Embodiment 3.

FIG. 19 is a top view of the image forming apparatus 300 according to Embodiment 3. FIG. 20 is a cross-sectional view of an internal configuration at C-C in FIG. 19, where only major components of the image forming apparatus 300 including the upper cover 311 according to Embodiment 3 are indicated. The upper cover 311 holds the wireless LAN module 30 by a wireless LAN holding portion 311*d*. The upper cover 311 includes support portions 311*a* and 311*b*, which are made of resin and extend downward in the apparatus, and is supported on the frame 20 by the support portions 311*a* and 311*b*, just like Embodiment 1. In other words, the upper cover 311 is supported on the left frame 21 and the right frame 22 directly or via another member, such as the support member 26.

In Embodiment 3 as well, in the region on the apparatus front side with respect to the wireless LAN module 30, the securing portion 21*b* and the support surface 23*b* are disposed at positions lower than the wireless LAN module 30, and the upper cover 311 is supported by the frame 20 via the support portions. The support portions 311*a* and 311*b* of the upper cover 311 and the support member 26 are made of resin, which can suppress a drop in wireless communication performance compared with the case of a metal frame that is disposed at the same height as the antenna 30*a*. In other words, good communication performance of the apparatus can be maintained, since the securing portion 21*b* and the support surface 23*b*, which are located on the apparatus front side with respect to the wireless LAN module 30, are both disposed at positions lower than the wireless LAN module 30. Because of this configuration, good wireless communication performance can be ensured while supporting the upper cover 311 with the metal frame.

By the above configuration, in the region on the apparatus front side with respect to the wireless LAN module 30, the frame 20, the power switch 2 and the operation instructing portion 3 can be disposed at positions lower than the wireless LAN module 30. In other words, the image forming apparatus that can ensure good communication performance can be provided while maintaining rigidity of the apparatus.

Embodiment 4

A configuration of an image forming apparatus 400 according to Embodiment 4 of the present invention will be described next with reference to FIGS. 21 to 26.

In Embodiment 4, a case where the present invention is applied to a monochrome laser beam printer, which can form monochrome images using an electrophotographic system, will be described. Application of the present invention is not limited to this, and the present invention is also applicable to such printers using a color tandem recording system, described in the above embodiments, and copiers, printers and the like using an electrostatic recording system or inkjet recording system.

In Embodiment 4 as well, directions are defined with respect to the user who is using the image forming apparatus 400. In other words, in a state of using the image forming apparatus 400, front side (front face side) of the image forming apparatus 400 that the user is facing is "front", rear face side (back side) "rear", upper face side (top face side) is "up", and lower face side (bottom face side) is "down". The left side face side of the image forming apparatus 400, when the image forming apparatus 400 is viewed from the front face side, is "left", and the right side face side thereof is "right".

(1) General Configuration of Image Forming Apparatus 400

Figure 21:
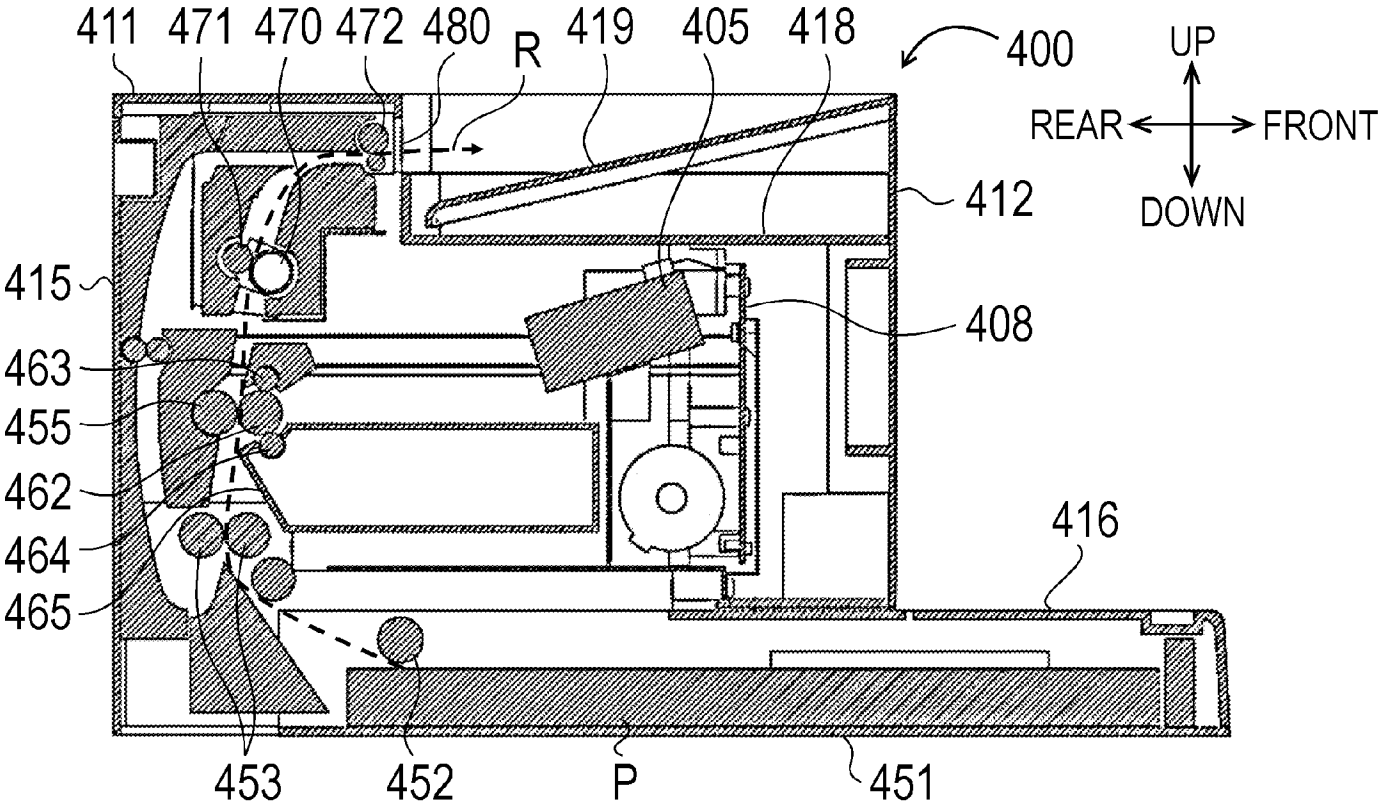
FIG. 21 is a schematic cross-sectional view of an image forming apparatus according to Embodiment 4.

FIG. 21 is a schematic cross-sectional view from the left side face side depicting a general configuration of the image forming apparatus 400 according to Embodiment 4 of the present invention. The image forming apparatus 400 includes an image forming portion and a fixing portion supported by the metal frame 20, and forms monochrome images.

The image forming portion includes a photosensitive drum 462 (image bearing member), a charging roller 463, a developing roller 464, and a toner container 465. The image forming portion may have a configuration of a process cartridge, which is integrally detachable from the apparatus. When image information is received and the image forming operation is started, the photosensitive drum 462 is rotated. First the outer peripheral surface of the photosensitive drum 462 is uniformly charged by the charging roller 463, and the charged surface is irradiated with a laser beam from a laser scanner 405 in accordance with the image information, so as to form an electrostatic latent image. The latent image becomes visible by the developing roller 464, whereby a toner image is formed on the surface of the photosensitive drum. A sheet type recording material P, which is stored in a feeding cassette 451 disposed in a lower portion of the image forming apparatus 400 before forming an image, is separated and fed one-by-one from the feeding cassette 451 to a resist roller pair 453 by a feeding roller 452. The resist roller pair 453 conveys the recording material P which was fed into a transfer nip portion between a transfer roller 455 and the photosensitive drum 462. Then when the recording material P passes through the transfer nip portion, bias is applied to the transfer roller 455 from an electric unit 408. Thereby a monochrome toner image is transferred from the surface of the photosensitive drum 462 to the recording material P which is passing through the transfer nip portion.

The recording material P bearing the toner is conveyed to a fixing portion (image heating portion). The fixing portion includes a heating unit 470 where a heater is disposed on the inner side of a flexible tubular film, and a pressure roller 471 which is disposed to face the heating unit 470. The carried toner image is fixed to the recording material P with heat in the fixing nip portion, which is constituted of the heating unit 470 and the pressure roller 471. Then the recording material P is discharged out of the image forming apparatus 400 (arrow R direction indicated in FIG. 21) into the discharging tray 419 by a discharging roller 472, through a discharging port 480.

Figure 22:
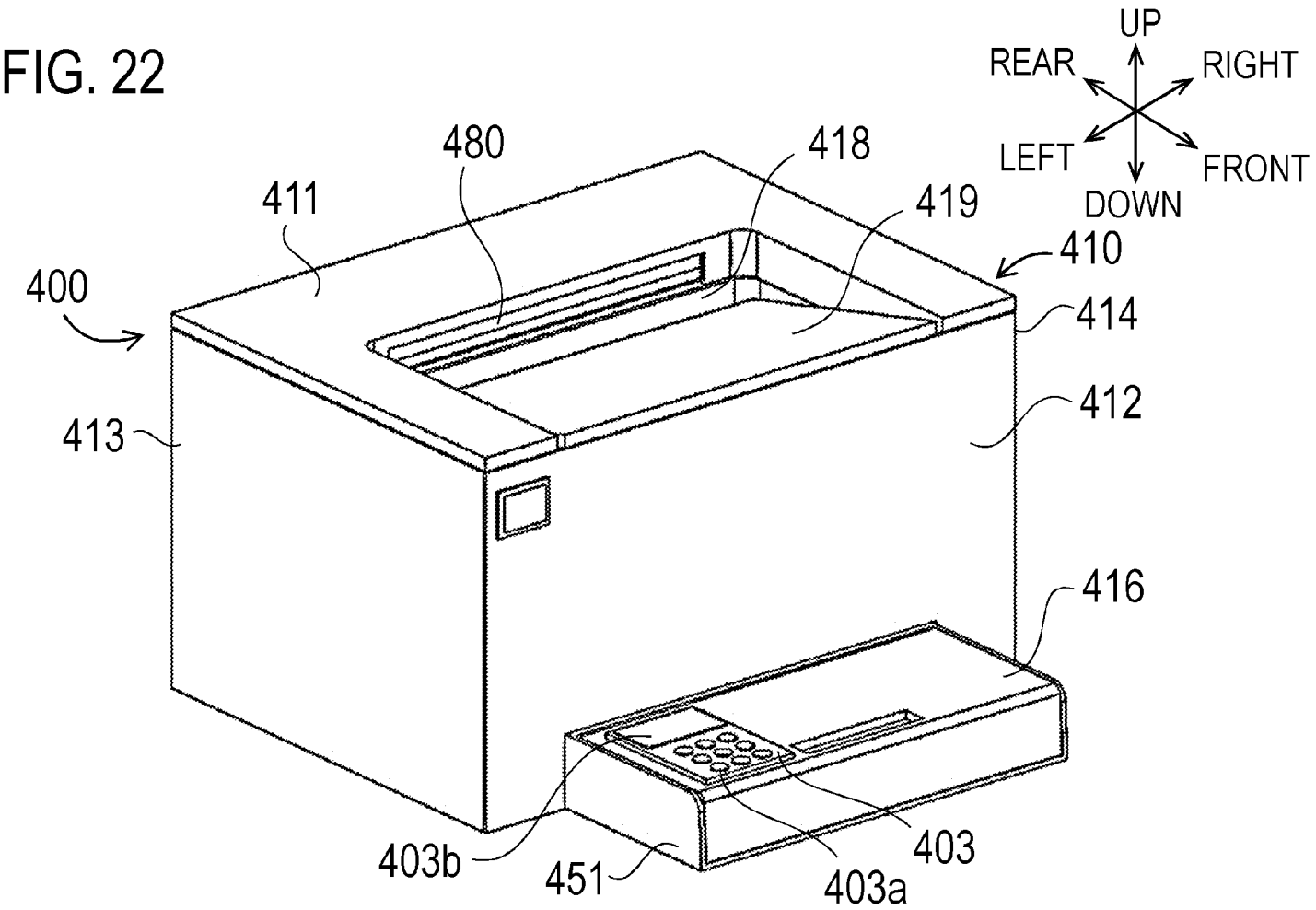
FIG. 22 is a perspective view of the image forming apparatus according to Embodiment 4.

FIG. 22 is a perspective view of the image forming apparatus 400 according to Embodiment 4 viewed from the apparatus front side. The image forming apparatus 400 is covered by a cover 410, which is a housing constituted of a plurality of members made of resin. In Embodiment 4, the cover 410 is constituted of an upper cover 411, a left cover 413, a right cover 414, a front cover 412, a cassette cover 416, a rear door 415, an internal cover 418, and a discharging tray 419. The upper cover (top cover) 411 covers at least a part of the top face side of the apparatus, and on the cassette cover 416, an operation instructing portion 403, which is an operation portion for the user to instruct operation of the printer, is disposed. The operation instructing portion 403 is located on the front side of the image forming apparatus 400, and includes operation buttons 403*a* for the user to instruct operation of the printer, and a monitor 403*b* to display the operation state of the apparatus.

(2) Positional Configuration of Wireless LAN Module 430

Figure 23:
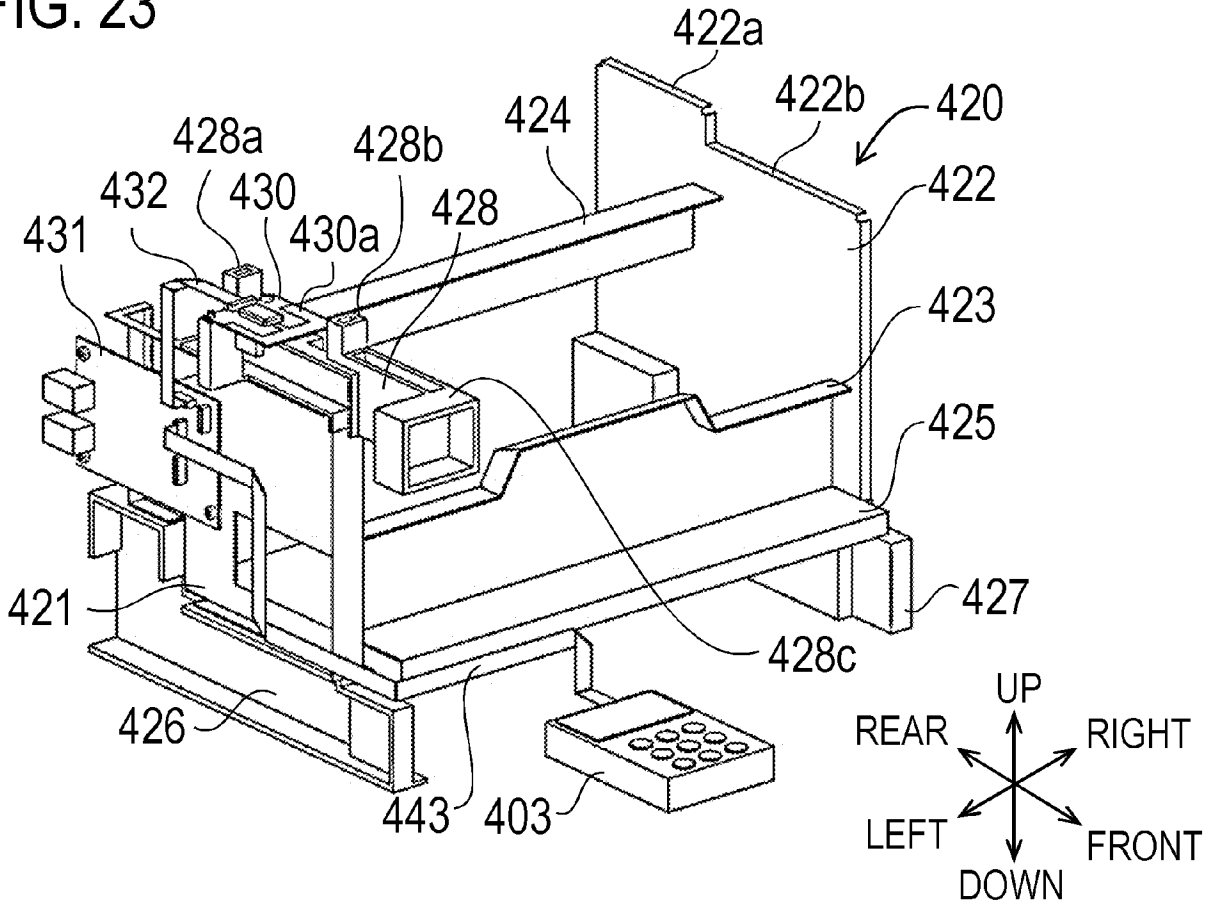
FIG. 23 is a perspective view inside the image forming apparatus according to Embodiment 4.
Figure 24:
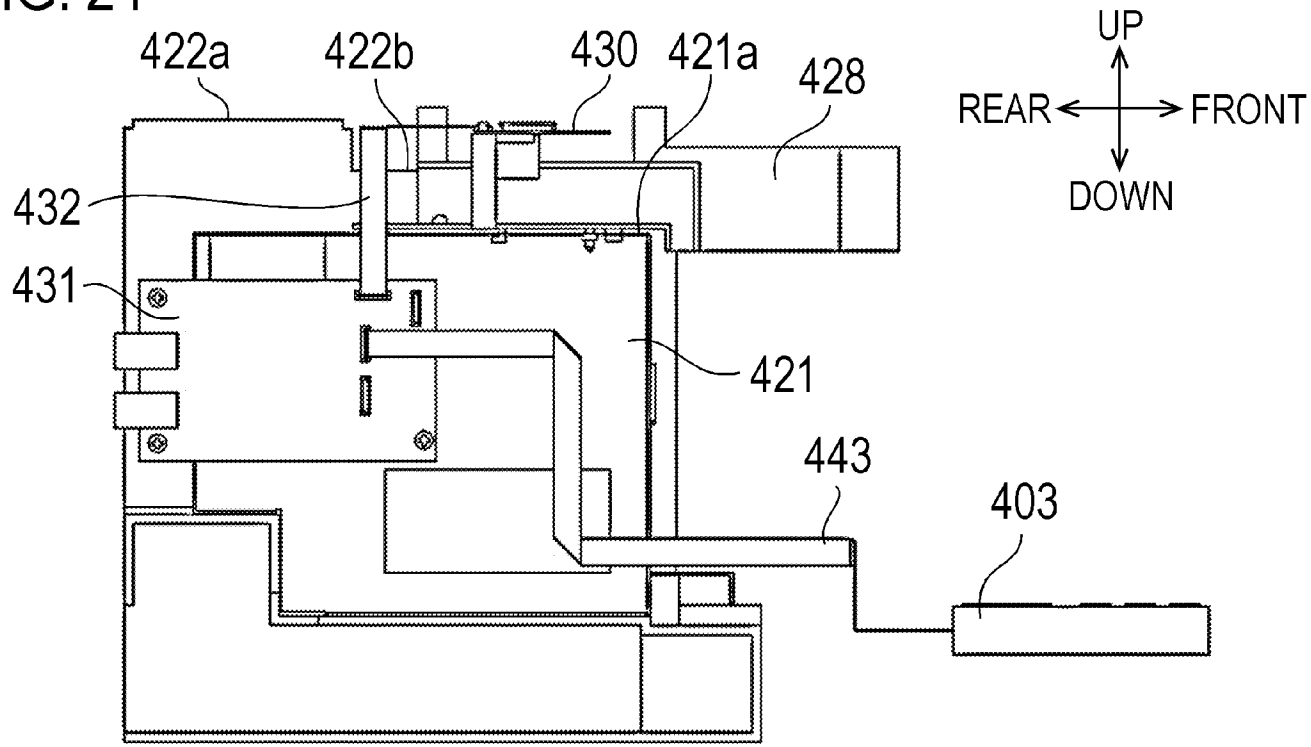
FIG. 24 is a left side view inside the image forming apparatus according to Embodiment 4.
Figure 25:
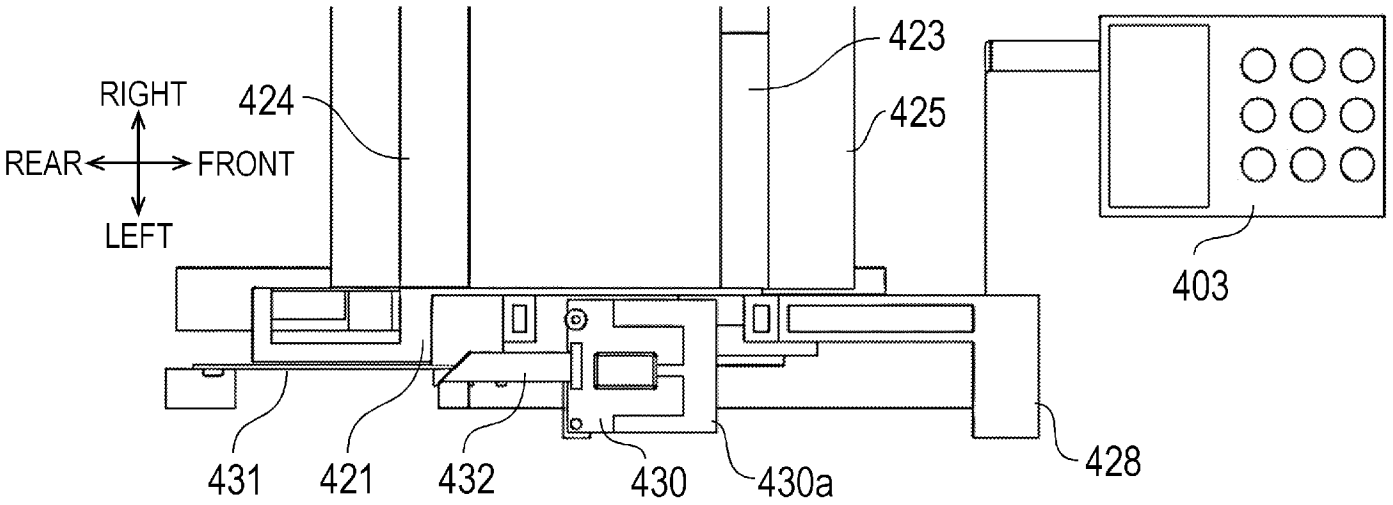
FIG. 25 is a top view inside the image forming apparatus according to Embodiment 4.

A positional relationship of a frame 420, a wireless LAN module 430, a control board 431 and an operation instructing portion 403 according to Embodiment 4 will be described with reference to FIGS. 23 to 25. FIG. 23 is a perspective view of an internal configuration of the image forming apparatus 400 according to Embodiment 4, where only major components are indicated without the cover 410, FIG. 24 is a left side view thereof, and FIG. 25 is a top view thereof. The frame 420 is disposed vertically, and includes a left frame 421 and a right frame 422, which are a pair of side plates facing each other. The frame 420 also includes a front frame 423, a rear frame 424 and a lower frame 425, which are disposed between the left frame 421 and the right frame 422. The front frame 423, the rear frame 424 and the lower frame 425 are disposed in a direction orthogonal to the surfaces of the left frame 421 and the right frame 422, so as to connect the left frame 421 and the right frame 422. The frame 420 also includes a lower left frame 426 and the lower right frame 427, which are made of resin, and the lower left frame 426 supports the left frame 421, and the lower right frame 427 supports the right frame 422. In Embodiment 4, in the front-rear direction, the right frame 422 is formed such that a rear upper face 422*a* located on the rear side is at a position higher than a front upper face 422*b* located on the front side. In other words, on the rear side where communication performance is not very critical as on the front side, the height of the frame 420 is increased to shorten the distance to the upper cover 411, so that the upper cover 411 can be more firmly supported. An upper face 421*a*, which is the upper end of the left frame 421, is located at a position even lower than a front upper face 422*b* of the right frame 422.

The image forming apparatus 400 according to Embodiment 4 further includes a support member 428 which is made of resin, and has a function to support the wireless LAN module 430 and a function to maintain the rigidity of the image forming apparatus. The support member 428 is secured on the upper face 421*a* of the left frame 421. The wireless LAN module 430 is supported by the support member 428, and is connected to the control board 431 which is installed on the left frame 421 via the flat cable 432. The support member 428 is supported above the left frame 421. In other words, the upper face 421*a* of the left frame 421 is located at a position vertically lower than the wireless LAN module 430. Further, the front upper face 422*b* of the right frame 422 located on the apparatus front side with respect to the wireless LAN module 430 is also located at a position vertically lower than the wireless LAN module 430. In other words, in a region on the apparatus front side with respect to the wireless LAN module 430, the upper face 421*a* of the left frame 421 and the rear upper face 422*a* of the right frame 422 are both located at positions lower than the wireless LAN module 430, hence good communication performance of the apparatus can be maintained.

The operation instructing portion 403 is disposed on the cassette cover 416 located at a position that is on the front side and the lower side of the apparatus, and is connected to the control board 431 via the flat cable 443. In other words, the operation instructing portion 403, which is located on the apparatus front side with respect to the wireless LAN module 430, is disposed at a position lower than the wireless LAN module 430. The type and route of each connection line and configuration of the frame are not limited to the configuration described above, but may be modified in various ways.

(3) Support Portion of Upper Cover 411

Figure 26:
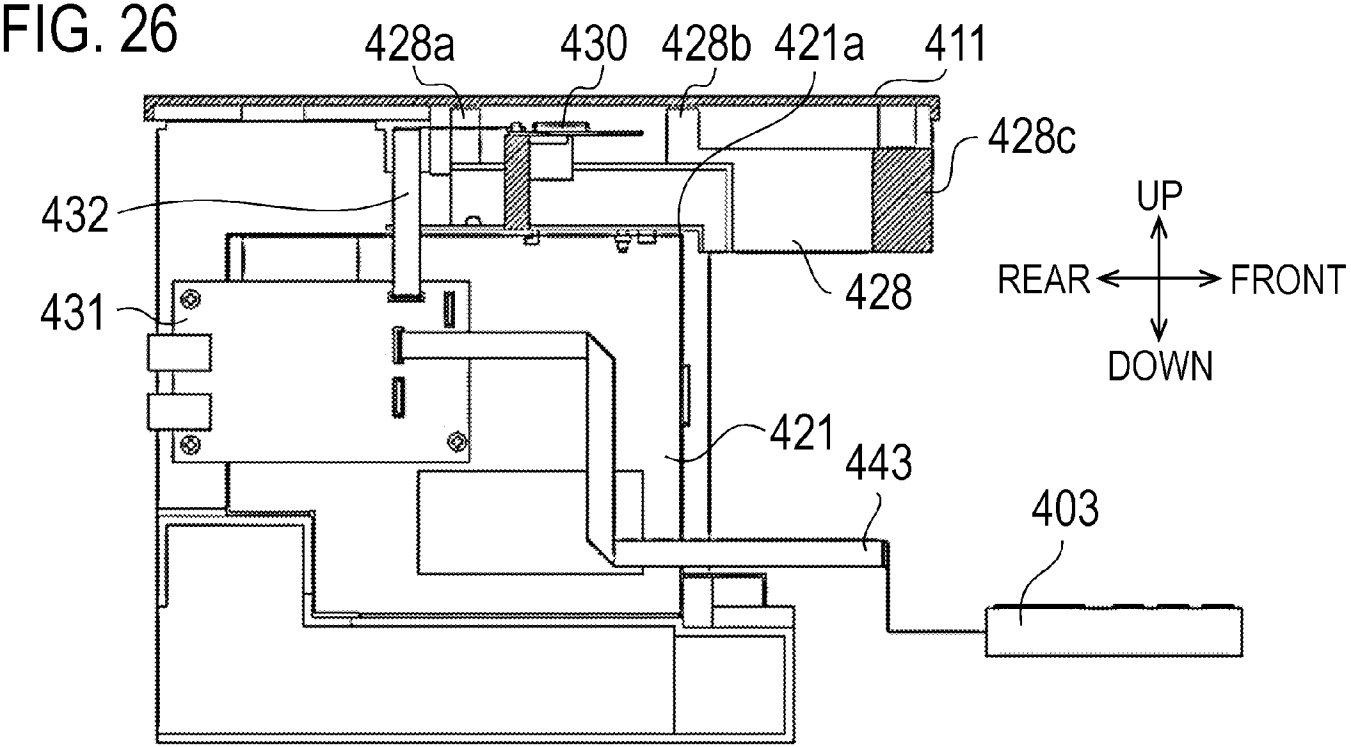
FIG. 26 is a cross-sectional view of the image forming apparatus according to Embodiment 4.

A support portion of the upper cover 411 according to Embodiment 4 will be described with reference to FIG. 26. FIG. 26 is a cross-sectional view of the internal configuration of the image forming apparatus 400 according to Embodiment 4, where only major components are indicated without the cover 410, other than the upper cover 411. The support member 428 disposed near the left end of the image forming apparatus 400 contacts the upper cover 411 at a rear support portion 428*a*, an intermediate support portion 428*b* and a front support portion 428*c*, and the left frame 421 supports the upper cover 411 via the support member 428. In a region near the right end of the apparatus, a support portion (not illustrated), which extends downward from the upper cover 411, contacts the front upper face 422*b* and the rear upper face 422*a* of the right frame 422. The upper cover 411 is made of resin, and the support portions thereof are also made of resin. Therefore the upper cover 411 is supported by the left frame 421 and the right frame 422 via the support portions made of resin.

In Embodiment 4 as well, in the region on the apparatus front side with respect to the wireless LAN module 430, the metal frame 420 is disposed at a position lower than the wireless LAN module 430, and the upper cover 411 is supported by the frame 420 via the support member 428. The upper cover 11 and the support member 428 are made of resin, and a drop in wireless communication performance can be suppressed compared with the case where the metal frame is disposed at a height the same as the antenna 430*a*. In other words, good communication performance of the apparatus can be maintained since the frame 420, which is located on the apparatus front side with respect to the wireless LAN module 430, is disposed at a position lower than the wireless LAN module 430. Because of this configuration, good wireless communication performance can be ensured while supporting the upper cover 411 by the metal frame.

By of the above configuration, even in Embodiment 4 which includes the support member 428, in the region on the apparatus front side with respect to the wireless LAN module 430, the frame 420 and the operation instructing portion 403 can be disposed at positions lower than the wireless LAN module 430. In other words, the image forming apparatus that can ensure good wireless communication performance can be provided while maintaining the rigidity of the apparatus.

In the above embodiments, the wireless LAN module, particularly the Wi-Fi module, was described as an example of the wireless communication board. However the present invention is not limited to this. A module of another communication system, such as near field communication (NFC) or Bluetooth may be used for the wireless communication board.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-116141, filed on Jul. 14, 2021 and Japanese Patent Application No. 2021-205753, filed on Dec. 20, 2021, which are hereby incorporated by reference herein in their entirety.

What is claimed is:

1. An image forming apparatus comprising:

an image forming portion configured to form an image on a recording material;

a first metal side plate and a second metal side plate disposed to sandwich the image forming portion;

a wireless communication board including an antenna configured to communicate with an external device; and a housing in which the image forming portion is disposed, wherein the housing includes a top cover that is disposed at a position vertically higher than the first metal side plate, the top cover directly supported by the first metal side plate and the second metal side plate, wherein, in a region on a downstream side with respect to the wireless communication board in a discharging direction where a recording material, on which an image is formed by the image forming portion, is discharged from a discharging port, an upper end of the first metal side plate is located at a position vertically lower than the wireless communication board, and a resin support portion connected to the first metal side plate is disposed in the region such that the resin support portion supports the top cover, and wherein the wireless communication board is held on the top cover.

2. The image forming apparatus according to claim 1, wherein the image forming apparatus further comprises a control board located on an upstream side with respect to the antenna in the discharging direction, and the control board controls an operation of the apparatus in accordance with an instruction transmitted from the wireless communication board.

3. The image forming apparatus according to claim 2, wherein the upper end of the first metal side plate in a region on the upstream side with respect to the antenna in the discharging direction is located at a position vertically higher than the upper end of the first metal side plate in a region on the downstream side with respect to the antenna in the discharging direction, and wherein an upper end of the control board is located at a position vertically higher than the upper end of the first metal side plate in the region on the downstream side.

4. The image forming apparatus according to claim 2, wherein the control board includes an external connector to connect to an external device via a cable.

5. The image forming apparatus according to claim 4, wherein the external connector includes at least a USB connector or a LAN connector.

6. The image forming apparatus according to claim 2, wherein the control board includes a connector to connect to the wireless communication board via a cable, and wherein the connector is located at a position vertically higher than the upper end of the first metal side plate in the region.

7. The image forming apparatus according to claim 1, wherein, in the region on the downstream side with respect to the antenna in the discharging direction, an upper end of the second metal side plate is located at a position vertically lower than the antenna, and wherein a resin support portion, which supports the top cover and is connected to the second metal side plate, is disposed in the region.

8. The image forming apparatus according to claim 1, wherein the resin support portion is integrally formed with the top cover.

9. The image forming apparatus according to claim 1, wherein the antenna is located at a position closer to the first metal side plate than to the second metal side plate.

10. The image forming apparatus according to claim 1, wherein the antenna is disposed in a region on an upstream side in the discharging direction with respect to a center portion of the first metal side plate in the discharging direction.

11. The image forming apparatus according to claim 1, wherein the antenna and the resin support portion are disposed along the upper end of the first metal side plate.

12. The image forming apparatus according to claim 1, wherein the wireless communication board includes a board surface on which the antenna is disposed, and wherein the wireless communication board is held so that the board surface crosses a vertical direction.

13. An image forming apparatus comprising:

an image forming portion configured to form an image on a recording material;

a first metal side plate and a second metal side plate disposed to sandwich the image forming portion;

a wireless communication board including an antenna configured to communicate with an external device;

a housing in which the image forming portion is disposed; and a feeding cassette configured to store a recording material, and to be insertable to or withdrawable from the housing, wherein the housing includes a top cover that is disposed at a position vertically higher than the first metal side plate, the top cover directly supported by the first metal side plate and the second metal side plate, wherein, in a region on a downstream side with respect to the antenna in a withdrawing direction of the feeding cassette, an upper end of the first metal side plate is located at a position vertically lower than the antenna, and a resin support portion connected to the first metal side plate is disposed in the region such that the resin support portion supports the top cover, and wherein the wireless communication board is held on the top cover.

14. The image forming apparatus according to claim 13, wherein the image forming apparatus further comprises a control board located on an upstream side with respect to the antenna in the withdrawing direction, and the control board controls an operation of the apparatus in accordance with an instruction transmitted from the antenna.

15. The image forming apparatus according to claim 14, wherein the upper end of the first metal side plate in a region on the upstream side with respect to the antenna in the withdrawing direction is located at a position vertically higher than the upper end of the first metal side plate in a region on the downstream side with respect to the antenna in the withdrawing direction, and wherein an upper end of the control board is located at a position vertically higher than the upper end of the first metal side plate in the region on the downstream side.

16. The image forming apparatus according to claim 14, wherein the control board includes an external connector to connect to an external device via a cable.

17. The image forming apparatus according to claim 16, wherein the external connector includes at least a USB connector or a LAN connector.

18. The image forming apparatus according to claim 14, wherein the control board includes a connector to connect to the wireless communication board via a cable, and wherein the connector is located at a position vertically higher than the upper end of the first metal side plate in the region.

19. The image forming apparatus according to claim 13, wherein in the region on the downstream side with respect to the antenna in the withdrawing direction, an upper end of the second metal side plate is located at a position vertically lower than the antenna, and wherein a resin support portion, which supports the top cover and is connected to the second metal side plate, is disposed in the region.

20. The image forming apparatus according to claim 13, wherein the antenna and the resin support portion are disposed along the upper end of the first metal side plate.

21. The image forming apparatus according to claim 13, wherein the wireless communication board includes a board surface on which the antenna is disposed, and wherein the wireless communication board is held so that the board surface crosses a vertical direction.

22. An image forming apparatus comprising:

an image forming portion configured to form an image on a recording material;

a first metal side plate and a second metal side plate disposed to sandwich the image forming portion, the first metal side plate including a surface facing the second metal side plate;

a wireless communication board including an antenna configured to communicate with an external device;

an operation portion configured to be operated by a user; and a housing in which the image forming portion is disposed, wherein the housing includes a top cover that is disposed at a position vertically higher than the first metal side plate, the top cover directly supported by the first metal side plate and the second metal side plate, wherein, when viewed in a direction vertical to the surface of the first metal side plate, the antenna and the operation portion are disposed in a horizontal direction, and in a region on a side where the operation portion is disposed, with respect to the antenna in the horizontal direction, an upper end of the first metal side plate is located at a position vertically lower than the antenna, and a resin support portion connected to the first metal side plate is disposed in the region such that the resin support portion supports the top cover, and wherein the wireless communication board is held on the top cover.

23. The image forming apparatus according to claim 22, wherein the operation portion includes at least a switch portion to turn a power supply of the apparatus ON/OFF, or an operation instructing portion to instruct an operation.

24. The image forming apparatus according to claim 22, wherein the image forming apparatus further comprises a control board located on a region that is on an opposite side of the side where the operation portion is disposed, with respect to the antenna in the horizontal direction, and the control board controls an operation of the apparatus in accordance with an instruction transmitted from the antenna.

25. The image forming apparatus according to claim 24, wherein an upper end of the first metal side plate in the region that is on the opposite side of the side where the operation portion is disposed, with respect to the antenna in the horizontal direction, is located at a position vertically higher than the upper end of the first metal side plate in the region on the side where the operation portion is disposed with respect to the antenna, and wherein an upper end of the control board is located at a position vertically higher than the upper end of the first metal side plate in a region on the side where the operation portion is disposed with respect to the antenna.

26. The image forming apparatus according to claim 22, wherein the antenna and the resin support portion are disposed along the upper end of the first metal side plate.

27. The image forming apparatus according to claim 22, wherein the wireless communication board includes a board surface on which the antenna is disposed, and wherein the wireless communication board is held so that the board surface crosses a vertical direction.

* * * * *